US009864290B2

(12) United States Patent
Yamawaki et al.

(10) Patent No.: US 9,864,290 B2
(45) Date of Patent: Jan. 9, 2018

(54) TONER FOR ELECTROPHOTOGRAPHIC PROCESSES AND ELECTROSTATIC PRINTING PROCESSES

(71) Applicant: CANON KABUSHIKI KAISHA, Tokyo (JP)

(72) Inventors: Kentaro Yamawaki, Mishima (JP); Shiro Kuroki, Suntou-gun (JP); Toshihiko Katakura, Kashiwa (JP); Akane Masumoto, Yokohama (JP); Tsuneyoshi Tominaga, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/589,761

(22) Filed: May 8, 2017

(65) Prior Publication Data

US 2017/0329246 A1 Nov. 16, 2017

(30) Foreign Application Priority Data

May 12, 2016 (JP) ..... 2016-095726

(51) Int. Cl.

| | |
|---|---|
| ***G03G 9/093*** | (2006.01) |
| ***G03G 9/097*** | (2006.01) |
| ***G03G 9/087*** | (2006.01) |
| ***G03G 9/08*** | (2006.01) |
| ***G03G 9/09*** | (2006.01) |

(52) U.S. Cl.

CPC ..... *G03G 9/09328* (2013.01); *G03G 9/0819* (2013.01); *G03G 9/0821* (2013.01); *G03G 9/0825* (2013.01); *G03G 9/0827* (2013.01); *G03G 9/08711* (2013.01); *G03G 9/0904* (2013.01); *G03G 9/09364* (2013.01); *G03G 9/09385* (2013.01); *G03G 9/09392* (2013.01); *G03G 9/09708* (2013.01)

(58) Field of Classification Search

CPC ..... G03G 9/09307; G03G 9/09314; G03G 9/09385; G03G 9/09783

See application file for complete search history.

(56) References Cited

U.S. PATENT DOCUMENTS

2015/0099224 A1* 4/2015 Abe ..... G03G 9/09328 430/110.2

FOREIGN PATENT DOCUMENTS

| | | |
|---|---|---|
| JP | 2014-010224 A | 1/2014 |
| JP | 2014-130202 A | 7/2014 |
| JP | 2014-130238 A | 7/2014 |

(Continued)

OTHER PUBLICATIONS

Tokyo Kagaku Dojin "Encyclopedic Dictionary of Chemistry" Resistivity, pp. 6, 122, 475, 808, 1363, 1677, 2272, 2273, 2372.

*Primary Examiner* — Peter Vajda

(74) *Attorney, Agent, or Firm* — Canon U.S.A., Inc. IP Division

(57) ABSTRACT

Disclosed is a toner including toner particles each including a core portion that contains a binder resin, and a surface layer containing an organosilicon polymer, in which each of the toner particles contains a polyvalent metal element having a resistivity of $2.5\times10^{-8}$ Ω·m or more and $10.0\times10^{-8}$ Ω·m or less at 20° C., and when the toner particles are subjected to X-ray fluorescence analysis, a net intensity originating from the polyvalent metal element is 0.10 kcps or more and 30.00 kcps or less.

6 Claims, 1 Drawing Sheet

(56) References Cited

FOREIGN PATENT DOCUMENTS

| | | | |
|---|---|---|---|
| JP | 2015-75662 | A | 4/2015 |
| JP | 2016-21041 | A | 2/2016 |
| JP | 2016-38448 | A | 3/2016 |

* cited by examiner

TONER FOR ELECTROPHOTOGRAPHIC PROCESSES AND ELECTROSTATIC PRINTING PROCESSES

BACKGROUND

Field of the Disclosure

The present disclosure relates to a toner used in image forming methods that include electrophotographic processes and electrostatic printing processes.

Description of the Related Art

Currently, methods for visualizing image information through electrostatic latent images, for example, electrophotography, are employed in various fields. In such methods, higher performance, such as higher image quality or higher speed, are required. Furthermore, toners used in such methods are required to have good environmental stability and storage stability because they are used at various temperatures and humidities and stored for prolonged periods of time.

In particular, colorants, release agents, and so forth contained in toners bleed onto surfaces thereof in high-temperature environments; thus, a change in the amount of electrostatic charge of toners and the soiling of members, such as developing rollers, regulating blades, and photosensitive members, with, toners are liable to occur.

Japanese Patent Laid-Open No. 2014-130238 discloses a technique using a toner that includes toner particles with a surface layer containing a specific organosilicon polymer. In this technique, it is possible to inhibit the bleeding of a material onto the surfaces of the toner particles in a high-temperature environment. Thus, the toner has good development endurance, good storage stability, good environmental stability, and good low-temperature fixability.

It was found that when continuous printing is performed in a low-temperature and low-humidity environment at a low printing ratio, ghosting is liable to occur. This is seemingly attributed to the fact that a toner that is located, at a portion corresponding to a non-image area and that is not developed is repeatedly rubbed against a regulating blade while being carried on a developer-carrying member, to cause the toner to be in an excessively charged state, what is called a "charge-up state".

Regarding techniques for inhibiting charge-up, Japanese Patent Laid-Open No. 2014-130202 discloses a technique in which three types of fine silica particles and a single type of fine alumina particles having a specific diameter are used as external additives. Japanese Patent Laid-Open No. 2014-010224 discloses a technique in which inorganic composite fine particles containing magnesium and aluminum are externally added and in which each of the content thereof and the static resistance is in a specific range.

In each of the techniques for inhibiting charge-up described in the foregoing documents, allowing excess charges to leak is its idea. In the case where the technique was applied to a toner including toner particles with a surface layer containing an organosilicon polymer, although its effect was provided at the beginning of use, the formation of a large number of sheets of images reduced the effect. The reason for this is presumably that because toner particles with a surface layer composed of an organosilicon polymer had a harder surface than toners in the related art and thus an external additive was not completely attached to the toner, the external additive was detached from the toner.

SUMMARY

As described above, in the toner including toner particles with a surface layer containing an organosilicon polymer in the related art, a difficulty lies in inhibiting charge-up.

The present disclosure provides a toner that has good development endurance, good storage stability, good environmental stability, and good low-temperature fixability and that that inhibits the occurrence of ghosting when continuous printing is performed at a low printing ratio in a low-temperature and low-humidity environment.

One aspect of the present disclosure is directed to providing a toner including toner particles each having a core portion containing a binder resin, and a surface layer containing an organosilicon polymer in which the organosilicon polymer has a partial structure represented by formula (1):

$$R—SiO_{3/2} \qquad \text{formula (1)}$$

within formula (1) R represents a hydrocarbon group having 1 or more and 6 or less carbon atoms, and when surfaces of the toner particles are subjected to X-ray photoelectron spectroscopy analysis to determine a carbon atom density dC, an oxygen atom density do, and a silicon atom density dSi, the silicon atom density dSi is 2.5 atomic % or more and 28.6 atomic % or less with respect to 100.0 atomic % of the total of the carbon atom density dC, the oxygen atom density do, and the silicon atom density dSi. In a chart obtained by subjecting tetrahydrofuran-insoluble matter of the toner particles to $^{29}$Si-NMR measurement, a percentage of an area of a peak assigned to the partial structure represented by formula (1) described above is 20% or more with respect to a total area of a peak of the organosilicon polymer. Each of the toner particles contains a polyvalent metal element having a resistivity of $2.5\times10^{-8}$ Ω·m or more and $10.0\times10^{-8}$ Ω·m or less at 20° C. and when the toner particles are subjected to X-ray fluorescence analysis, a net intensity originating from the polyvalent metal element is 0.10 kcps or more and 30.00 kcps or less.

Further features of the present disclosure will become apparent from the following description of exemplary embodiments with reference to the attached drawings.

DESCRIPTION OF THE EMBODIMENTS

Figure 1:
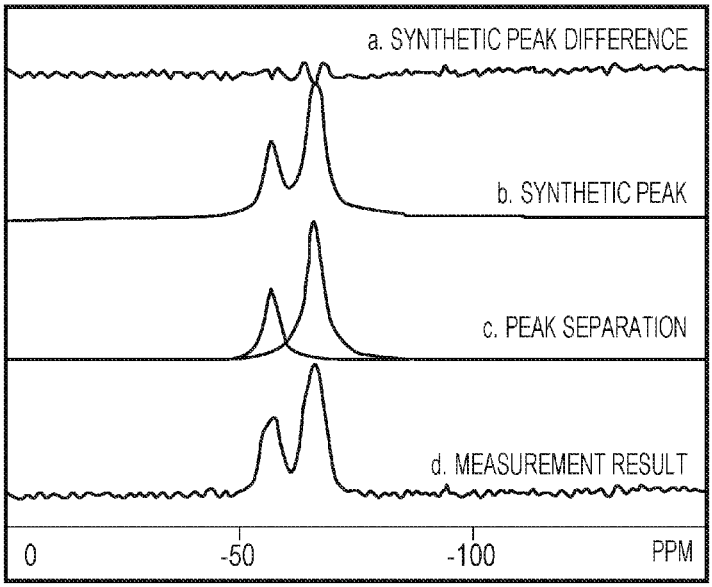
FIG. 1 is an example of a $^{29}$Si-NMR chart of toner particles according to an embodiment of the present disclosure.

A toner according to an embodiment of the present disclosure includes toner particles that include a core portion containing a binder resin and a surface layer containing a specific organosilicon polymer. The toner contains a polyvalent metal element having a resistivity of $2.5\times10^{-8}$ Ω·m or more and $10.0\times10^{-8}$ Ω·m or less at 20° C. A net intensity originating from the polyvalent metal element obtained by X-ray fluorescence analysis of the toner particles is 0.10 kcps or more and 30.00 kcps or less, in the X-ray fluorescence analysis, a specimen is irradiated with continuous X-rays to generate characteristic X-rays (fluorescent X-rays)

inherent in elements contained in the specimen. The generated fluorescent X-rays are dispersed by an analyzing crystal (in a wavelength-dispersive manner) to form a spectrum. The spectrum is measured, and then constituent elements are quantitatively analyzed from the intensity thereof. The term "net intensity" refers to an X-ray intensity obtained by subtracting the background intensity from an X-ray intensity at a peak angle indicating the presence of the metal element. The term "polyvalent metal element" used herein refers to a metal element that forms polyvalent metal ions.

The charge-up of the toner can be solved by allowing excess charges to leak, as disclosed in the related art. To allow charges to leak appropriately, it is conceivable that a material having a specific resistivity will be incorporated into the toner. The inventors have conducted studies and have found that selecting a polyvalent metal element from materials having a specific resistivity is significantly effective in inhibiting the charge-up. This is seemingly attributed to the fact that the incorporation of the polyvalent metal having a specific resistivity provides the effect of allowing excess charges to leak and the effect of reducing silanol groups having a high negative chargeability.

Furthermore, the applicants have found that because the polyvalent metal having a specific resistivity is incorporated, the detachment of small particles and the cracking of the toner particles are less likely to occur even when strong shear is applied to the toner, a problem, such as a development stripe, that is attributed to the detachment and the cracking, can be less likely to occur. The reason for this is presumably that because the incorporated metal is polyvalent, when a carboxyl group is present in the binder resin and/or when a silanol group is present in the organosilicon polymer, metal crosslinking is formed to increase the strength. It should be understood that regarding the organosilicon polymer, a difficulty lies in eliminating the silanol group and thus the silanol group is present even in a small amount.

Resistivities of various substances at 20° C. are described in, for example, "Kagaku Daijiten (ENCYCLOPEDIC DICTIONARY OF CHEMISTRY)", first edition; Tokyo Kagaku Dojin, 1989. In the present disclosure, a polyvalent metal element having a resistivity of $2.5\times10^{-8}$ Ω·m or more and $10.0\times10^{-8}$ Ω·m needs to be used. Examples of the polyvalent metal element having the foregoing resistivity include aluminum ($2.7\times10^{-8}$ Ω·m), calcium ($3.5\times10^{-8}$ Ω·m), magnesium ($4.5\times10^{-8}$ Ω·m), tungsten (about $5\times10^{-8}$ Ω·m), molybdenum (about $5\times10^{-8}$ Ω·m), cobalt ($6.2\times10^{-8}$ Ω·m), zinc ($5.8\times10^{-8}$ Ω·m), nickel ($6.8\times10^{-8}$ Ω·m), and iron ($9.7\times10^{-8}$ Ω·m). When the resistivity of the polyvalent metal element at 20° C. is in the range described above, the occurrence of the leakage of charges is inhibited in a high-temperature and high-humidity environment while the occurrence of charge-up is inhibited.

When the net intensity originating from the polyvalent metal element obtained by X-ray fluorescence analysis is 0.10 kcps or more, the effect of inhibiting charge-up is sufficiently provided. Because the presence of an excessively large amount of the polyvalent metal element is liable to cause fogging resulting from the leakage of charges in a high-temperature and high-humidity environment, the net intensity needs to be 30.00 kcps or less. The net intensity may be 20.00 kcps or less. When two or more polyvalent metal elements having a resistivity within the range described above are incorporated, the net intensity is defined as the total net intensity of the polyvalent metal elements.

A method for incorporating the polyvalent metal element into the toner particles is not particularly limited. Because a difficulty lies in the incorporation after the formation of the surface layer composed of the organosilicon polymer, the incorporation may be performed prior to the formation of the surface layer or while the surface layer is being formed. For example, in the case where the toner particles are produced by a pulverization process, the polyvalent metal element may be incorporated into the toner particles by incorporation of the polyvalent metal element into a raw-material resin in advance or addition of the polyvalent metal element when raw materials are melt-kneaded. In the case where the toner particles are produced by a wet production process such as a polymerization process, the polyvalent metal element may be incorporated into raw materials or may be added through an aqueous medium during the production. The incorporation of the polyvalent metal element into the toner particles through an ionized state in the aqueous medium in the wet production process may be performed in view of uniformity. Aluminum, iron, magnesium, or calcium may be used as the polyvalent metal element because these elements have a relatively high ionization tendency and are easily ionized.

Any form of the polyvalent metal element may be incorporated during the production. The polyvalent metal element may be used in an elemental form or in the form of a halide, a hydroxide, an oxide, a sulfide, a carbonate, a sulfate, a hexafluorosilylate, an acetate, a thiosulfate, a phosphate, a chlorate, a nitrate, or the like. As described above, the polyvalent metal element may be incorporated into the toner particles through an ionized state in the aqueous medium. The term "aqueous medium" refers to a medium having a water content of 50% or more by mass and a water-soluble organic solvent content of 50% or less by mass. Examples of the water-soluble organic solvent include methanol, ethanol, isopropanol, butanol, acetone, methyl ethyl ketone, and tetrahydrofuran.

In the case where a toner is produced in an aqueous medium containing hydroxyapatite and where calcium is used as the polyvalent metal element, the amount of calcium added needs to be carefully determined. The chemical formula of hydroxyapatite is $Ca_{10}(PO_4)_6(OH)_2$. The ratio of calcium to phosphorus is 1.67. When $M(Ca)\leq1.67M(P)$, where the number of moles of calcium is denoted by M(Ca), and the number of moles of phosphorus is denoted by M(P), calcium is easily incorporated into hydroxyapatite. Thus, if calcium is not present in an amount more than the amount described above, calcium is not easily incorporated into the toner.

Surface Layer Containing Organosilicon Polymer

The surface layer according to an embodiment of the present disclosure is a layer that covers the core portion and that is present on the outermost surface of each of the toner particles. The surface layer may cover the entire surface of the core portion. However, the surface of the core portion may not be partially covered with the surface layer. In an embodiment of the present disclosure, the percentage of the number of line segments on which the thicknesses of the surface layers, containing the organosilicon polymer, of the toner particles is 2.5 nm or less (hereinafter, also referred to as "the percentage of the surface layers having a thickness of 2.5 nm or less") is preferably 20.0% or less, and the details will be described below. This requirement approximates the fact that 80.0% or more by area of the surface of each of the toner particles is covered with the surface layer having a thickness of 2.5 nm or more and containing the organosilicon polymer. That is, when the requirement is met, the surface layer containing the organosilicon polymer sufficiently covers the surface of the core portion. The percentage of the portion of the surface layer having a thickness of 2.5 nm or less is more preferably 10.0% or less. The measurement is performed by cross-sectional observation using a transmission electron microscope (TEM). The details thereof will be described below.

The organosilicon polymer in the toner according to an embodiment of the present disclosure includes a partial structure represented by formula (1). A siloxane bond (Si—O—Si) in which two Si atoms share one oxygen atom is expressed as $—SiO_{1/2}$. A moiety in which three siloxane bonds are attached to a Si atom is expressed as $—SiO_{3/2}$. In the partial structure represented by formula (1), one of the four chemical bonds of the Si atom is attached to R, and the remaining three bonds are siloxane bonds, $$R—SiO_{3/2} \qquad \text{formula (1)}$$

wherein R represents a hydrocarbon group having 1 or more and 6 or less carbon atoms.

The $—SiO_{3/2}$ moiety seemingly has nature similar to silica ($SiO_2$), which is composed of a large number of siloxane bonds. Thus, in the toner according to an embodiment of the present disclosure, a state similar to that of the case where silica is added to the surface is seemingly formed. This can improve the hydrophobicity of the surface of each of the toner particles to improve the environmental stability of the toner.

When surfaces of the toner particles are analyzed by X-ray photoelectron spectroscopy analysis (also known as electron spectroscopy for chemical analysis (ESCA)) to determine a carbon atom density dC, an oxygen atom density do, and a silicon atom density dSi, the silicon atom density dSi is 2.5 atomic % or more and 28.6 atomic % or less with respect to 100.0 atomic % of the total of the carbon atom density dC, the oxygen atom density do, and the silicon atom density dSi.

ESCA is used to perform the elemental analysis of the surface layers each extending from the surface of each of the toner particles toward the center of the toner particle (the midpoint of a long axis) and having a thickness of several nanometers. A silicon atom density dSi in the surface layers of the toner particles of 2.5 atomic % reduces the surface free energy of the surface layers to improve the flowability, thereby inhibiting the soiling of members and the occurrence of fogging. In an embodiment of the present disclosure, the silicon atom density dSi needs to be 28.6 atomic % or less in view of chargeability. At a silicon atom density dSi more than 28.6 atomic %, the effect of inhibiting charge-up is not sufficiently provided even if the foregoing polyvalent metal element is incorporated.

The silicon atom density in the surface layers of the toner particles can be controlled by adjusting the type and amount of an organosilicon compound used for the formation of the organosilicon polymer. The silicon atom density can also be controlled by adjusting the structure of R in formula (1), a method for producing the toner particles, the reaction temperature, the reaction time, the reaction solvent, and the pH at the time of the formation of the organosilicon polymer.

In a chart obtained by the $^{29}$Si-NMR measurement of a tetrahydrofuran (THF)-insoluble matter of the toner particles of the toner according to an embodiment of the present disclosure, the percentage of the area of a peak assigned to the structure of formula (1) is 20% or more with respect to the total peak area of the organosilicon polymer. The details of a measurement method will be described below. This approximates the fact that the percentage of Si atoms having the partial structure expressed as $R—SiO_{3/2}$ in the organosilicon polymer contained in the toner particles is 20% or more of the total. Si atoms in the organosilicon polymer. As described above, the moiety expressed as $—SiO_{3/2}$ indicates that three of the four chemical bonds of the Si atom are attached to oxygen atoms and these oxygen atoms are attached to other Si atoms. When one of these oxygen atoms is contained in a silanol group, the partial structure of the organosilicon polymer is expressed as $R—SiO_{2/2}—OH$. When two of these oxygen atoms are contained in silanol groups, the partial structure is expressed as $R—SiO_{1/2}(—OH)_2$. A comparison of these structures reveals that the partial structure in which a larger number of oxygen atoms are cross-linked to Si atoms to form cross-linked structures is closer to a silica structure expressed as $SiO_2$. A larger number of the $—SiO_{3/2}$ moieties results in a lower surface free energy of the surfaces of the toner particles and thus good environmental stability and good resistance to the soiling of members. A smaller number of the $—SiO_{3/2}$ moieties results in a larger number of the silanol groups having negative chargeability, thereby failing to completely inhibit the charge-up, in some cases. Accordingly, the percentage of the partial structure expressed as $R—SiO_{3/2}$ needs to be 20% or more and preferably 40% or more and 80% or less in view of chargeability and endurance.

Furthermore, good hydrophobicity and good chargeability originating from R in formula (1) are obtained in addition to good endurance originating from the partial structure. These effects satisfactorily inhibit bleeding of a resin having a low molecular weight (Mw) of 1000 or less and a resin having a low glass transition temperature (Tg) of 40° C. or lower, and, depending on circumstances, a release agent, the resins and release agent being present inside the toner particles and liable to bleed. This results in improved agitation properties of the toner, so that the toner has good storage stability, good environmental stability during a high-printing-ratio image-output endurance test at a printing ratio of 30% or more, and good development endurance.

The percentage of the area of the peak assigned to the partial structure can be controlled by adjusting the type and amount of the organosilicon compound used for the formation of the organosilicon polymer, and the reaction temperature, the reaction time, the reaction solvent, and the pH in hydrolysis, addition polymerization, and polycondensation at the time of the formation of the organosilicon polymer.

In the partial structure represented by formula (1), R represents a hydrocarbon group having 1 or more and 6 or less carbon atoms. When R is a hydrocarbon having 1 or more and 6 or less carbon atoms, satisfactory environmental stability is provided.

In an embodiment of the present disclosure, R is preferably a hydrocarbon having 1 or more and 5 or less carbon atoms or a phenyl group and more preferably a hydrocarbon having 1 or more and 3 or less carbon atoms in view of chargeability and the prevention of fogging. A satisfactory chargeability results in good transferability to reduce the amount of an untransferred toner, thereby inhibiting the soiling of a drum, a charging member, and a transfer member.

Examples of the hydrocarbon having 1 or more and 3 or less carbon atoms include methyl, ethyl, propyl, and vinyl groups. R may represent a methyl group in view of the environmental stability and the storage stability.

A typical example of a method for producing the organosilicon polymer is what is called a sol-gel method. The sol-gel method is a method in which a liquid raw material serving as a starting material is subjected to hydrolysis and polycondensation to form a sol state, followed by gelation. The sol-gel method is employed to prepare glass, ceramics, organic-inorganic hybrids, and nanocomposites. A functional material in the form of any of surface layers, fibers, bulk bodies, fine particles, and so forth can be produced from a liquid phase at a low temperature by this production method.

Specifically, the organosilicon polymer present in the surface layers of the toner particles may be formed by the hydrolysis and the polycondensation of a silicon compound such as an alkoxysilane.

The uniform arrangement of the surface layer containing the organosilicon polymer on each of the toner particles provides a toner having improved environmental stability without incorporating an external additive and good storage stability in which the performance of the toner is less likely to degrade when the toner is used for prolonged periods of time.

In the sol-gel method, a liquid is used as a starting material and allowed to gel to form a material, thus enabling the formation of various microstructures and forms. In particular, when the toner particles are produced in an aqueous medium, the organosilicon polymer is easily precipitated on the surfaces of the toner particles because of hydrophilicity originating from a hydrophilic group such as a silanol group of the organosilicon compound. The microstructure and the form can be controlled by adjusting the reaction temperature, the reaction time, the reaction solvent, the pH, the type and amount of an organometallic compound, and so forth.

The organosilicon polymer according to an embodiment of the present disclosure may be prepared by the polycondensation of an organosilicon compound having a structure represented by formula (Z) illustrated below. The polycondensation of the organosilicon compound may be performed in the presence of the ionized polyvalent metal element from the viewpoint of improving the strength of the organosilicon polymer.

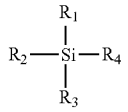

(Z)

wherein, in formula (Z), $R_1$ represents a hydrocarbon group having 1 or more and 6 or less carbon atoms, and $R_2$, $R_3$, and $R_4$ each independently represent a halogen atom, a hydroxy group, an acetoxy group, or an alkoxy group.

$R_1$ is a group that will serve as R in formula (1) after polymerization and may be the same group as described above.

$R_2$, $R_3$, and $R_4$ each independently represent a halogen atom, a hydroxy group, an acetoxy group, or an alkoxy group (hereinafter, also referred to as a "reactive group"). These reactive groups undergo hydrolysis, addition polymerization, and polycondensation to form a cross-linked structure, thereby providing a toner having good resistance to soiling of members and good development endurance. Each of the reactive groups may be an alkoxy group and may be a methoxy group or an ethoxy group in view of mild hydrolyzability at room temperature and ease of precipitation and coatability on the surfaces of the toner particles. The hydrolysis, the addition polymerization, and the polycondensation of $R_2$, $R_3$, and $R_4$ can be controlled by adjusting the reaction temperature, the reaction time, the reaction solvent, and the pH.

To prepare the organosilicon polymer used in an embodiment of the present disclosure, one or more of the organosilicon compounds, represented by formula (Z), each including three reactive groups ($R_2$, $R_3$, and $R_4$) and one not-reactive group ($R_1$) in its molecule may be used alone or in combination of two or more (hereinafter, such organosilicon compounds are also referred to as "trifunctional silanes").

Examples of the organosilicon compounds represented by formula (Z) illustrated above include:

trifunctional methylsilanes, such as methyltrimethoxysilane, methyltriethoxysilane, methyldiethoxymethoxysilane, methylethoxydimethoxysilane, methyltrichlorosilane, methylmethoxydichlorosilane, methylethoxydichlorosilane, methyldimethoxychlorosilane, methylmethoxyethoxychlorosilane, methyldiethoxychlorosilane, methyltriacetoxysilane, methyldiacetoxymethoxysilane, methyldiacetoxyethoxysilane, methylacetoxydimethoxysilane, methylacetoxymethoxyethoxysilane, methylacetoxydiethoxysilane, methyltrihydroxysilane, methylmethoxydihydroxysilane, methylethoxydihydoxysilane, methyldimethoxyhydroxysilane, methylethoxymethoxyhydroxysilane, and methyldiethoxyhydroxysilane;

trifunctional silanes, such as ethyltrimethoxysilane, ethyltriethoxysilane, ethyltrichlorosilane, ethyltriacetoxysilane, ethyltrihydroxysilane, propyltrimethoxysilane, propyltriethoxysilane, propyltrichlorosilane, propyltriacetoxysilane, propyltrihydroxysilane, butyltrimethoxysilane, butyltriethoxysilane, butyltrichlorosilane, butyltriacetoxysilane, butyltrihydroxysilane, hexyltrimethoxysilane, hexyltriethoxysilane, hexyltrichlorosilane, hexyltriacetoxysilane, and hexyltrihydroxysilane; and trifunctional phenylsilanes, such as phenyltrimethoxysilane, phenyltriethoxysilane, phenyltrichlorosilane, phenyltriacetoxysilane, and phenyltrihydroxysilane.

In an embodiment of the present disclosure, the organosilicon polymer may be prepared from the organosilicon compound having the structure represented by formula (Z) in combination with the following compound as long as the advantageous effects of the present disclosure are not impaired: an organosilicon compound having four reactive groups in its molecule (tetrafunctional silane), an organosilicon compound having two reactive groups in its molecule (bifunctional silane), or an organosilicon compound having one reactive group (monofunctional silane).

Examples of the organosilicon compounds include trifunctional vinylsilanes, such as dimethyldiethoxysilane, tetraethoxysilane, hexamethyldisilazane, 3-aminopropyltrimethoxysilane, 3-aminopropyltrimethoxysilane, 3-(2-aminoethyl)aminopropyltrimethoxysilane, 3-(2-aminoethyl) aminopropyltriethoxysilane, vinyltriisocyanatosilane, vinyltrimethoxysilane, vinyltriethoxysilane, vinyldiethoxymethoxysilane, vinylethoxydimethoxysilane, vinylethoxydihydroxysilane, vinyldimethoxyhydroxysilane, vinylethoxymethoxyhydroxysilane, and vinyldiethoxyhydroxysilane.

The toner may have an organosilicon polymer content of 0.5% or more by mass and 10.5% or less by mass, and each of the surface layers containing the organosilicon polymer may have an average thickness Dav. of 5.0 nm or more and 100.0 nm or less.

An organosilicon polymer content of 0.5% or more by mass results in a further reduction in the surface free energy of each surface layer to improve the flowability, thereby further inhibiting the soiling of members and the occurrence of fogging. An organosilicon polymer content of 10.5% or less by mass results in a more satisfactory inhibitory effect of the polyvalent metal element on charge-up. The organosilicon polymer content can be controlled by adjusting the type and amount of an organosilicon compound used for the formation of the organosilicon polymer, the method for producing the toner particles, the reaction temperature, the reaction time, the reaction solvent, and the pH at the time of the formation of the organosilicon polymer.

The average thickness of each of the surface layers in an embodiment of the present disclosure is determined by a method described below. Each of the surface layers containing the organosilicon polymer may be in close contact with a corresponding one of the core portions in an embodiment of the present disclosure. In other words, each surface layer may not be a granular cover layer. In this case, the occurrence of bleeding of a resin component, a release agent, or the like from the inner portion of each toner particle below the surface layer is inhibited to provide a toner having good storage stability, good environmental stability, and good development endurance. When the average thickness Dav. of the toner particle is within the range described above, the bleeding of the resin component, the release agent, or the like onto the surface of the toner particle can be satisfactorily inhibited without impeding the fixability. The average thickness Dav. can be controlled by adjusting the organosilicon polymer content and the method for producing the toner particles at the time of the formation of the organosilicon polymer. The average thickness Dav. can also be controlled by adjusting the numbers of carbon atoms in the hydrocarbon group and hydrophilic groups in formula (1), and the reaction temperature, the reaction time, the reaction solvent, and the pH in the addition polymerization and the polycondensation at the time of the formation of the organosilicon polymer.

Each of the surface layers may contain a resin, such as a styrene-acrylic copolymer resin, a polyester resin, or a urethane resin, or any of various additives in addition to the specific organosilicon polymer.

Core Portion Containing Binder Resin

The core portion included in each of the toner particles in an embodiment of the present disclosure contains the binder resin. The binder resin is not particularly limited and any binder resin known in the art can be used.

The binder resin may contain a carboxy group, and the polyvalent metal element may be a metal element selected from the group consisting of aluminum, iron, magnesium, and calcium. When the polyvalent metal element contained is aluminum, the net intensity originating from aluminum may be 0.10 kcps or more and 0.50 kcps or less, the net intensity being obtained by subjecting the toner particles to X-ray fluorescence analysis. When the polyvalent metal element is iron, the net intensity originating from iron may be 1.00 kcps or more and 5.00 kcps or less, the net intensity being obtained by subjecting the toner particles to X-ray fluorescence analysis. When the polyvalent metal element is magnesium or calcium, the net intensity originating from magnesium or calcium may be 3.00 kcps or more and 20.00 kcps or less, the net intensity being obtained by subjecting the toner particles to X-ray fluorescence analysis. It was found that the combination described above allows the detachment of small particles and the cracking thereof to be further less likely to occur even when strong shear is applied to the toner. The reason for this is presumably that the presence of the carboxy group of the binder resin, the silanol group left in the organosilicon polymer, and the polyvalent metal that is relatively easily ionized results in the formation of metal crosslinking to increase the bonding strength between the core portion and the surface layer. Variations in the range of the net intensity from material to material are seemingly related to the valence of the metals. That is, a high-valent metal can be coordinated with many silanol groups and carboxy groups in a small amount. It is thus thought that aluminum is trivalent and used in a small amount, magnesium or calcium is divalent and used in a large amount, and iron is mixed valent and used in an intermediate amount.

Binder Resin

Examples of the binder resin include vinyl-based resins and polyester resins. Vinyl-based resins, polyester resins, and other binder resins are exemplified as follows.

Examples thereof include homopolymers of styrene and substitution products thereof, such as polystyrene and poly (vinyltoluene); styrene-based copolymers, such as styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-dimethylaminoethyl acrylate copolymers, styrene-methyl methacrylate copolymers, styrene-ethyl methacrylate copolymers, styrene-butyl methacrylate copolymers, styrene-dimethylaminoethyl methacrylate copolymers, styrene-methyl vinyl ether copolymers, styrene-ethyl vinyl ether copolymers, styrene-methyl vinyl ketone copolymers, styrene-butadiene copolymers, styrene-isoprene copolymers, styrene-maleic acid copolymers, and styrene-maleate copolymers; and polymethyl methacrylate, polybutyl methacrylate, poly(vinyl acetate), polyethylene, polypropylene, polyvinyl butyral), silicone resins, polyamide resins, epoxy resins, polyacrylic resins, rosins, modified rosins, terpene resins, phenolic resins, aliphatic and alicyclic hydrocarbon resins, and aromatic petroleum resins. These binder resins may be used alone or in combination as a mixture.

The binder resin may contain a carboxy group and may be prepared from a polymerizable monomer containing a carboxy group. Examples thereof include vinyl group-containing carboxylic acids, such as acrylic acid, methacrylic acid, α-ethylacrylic acid, and crotonic acid; unsaturated dicarboxylic acids, such as fumaric acid, maleic acid, citraconic acid, and itaconic acid; and unsaturated dicarboxylic acid monoester derivatives, such as mono(acryloyloxy)ethyl succinate, mono(methacryloyloxy)ethyl succinate, mono(acryloyloxy)ethyl phthalate, and mono(methacryloyloxy)ethyl phthalate.

As the polyester resin, a product prepared by the polycondensation of a carboxylic component and an alcohol component described below may be used. Examples of the carboxylic acid component include terephthalic acid, isophthalic acid, phthalic acid, fumaric acid, maleic acid, cyclohexanedicarboxylic acid, and trimellitic acid. Examples of the alcohol component include bisphenol A, hydrogenated bisphenol, ethylene oxide adducts of bisphenol A, propylene oxide adducts of bisphenol A, glycerol, trimethylolpropane, and pentaerythritol.

The polyester resin may be a polyester resin containing a urea group. A carboxy group located at a terminus or the like may not be capped.

In the toner according to an embodiment of the present disclosure, the resin may contain a polymerizable functional group in order to improve a change in the viscosity of the toner at high temperatures. Examples of the polymerizable functional group include vinyl, isocyanato, epoxy, amino, carboxy, and hydroxy groups.

Crosslinking Agent

To control the molecular weight of the binder resin contained in the toner particles, a crosslinking agent may be added at the time of polymerization of a polymerizable monomer.

Examples thereof include ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol dimethacrylate, neopentyl glycol diacrylate, divinylbenzene, bis(4-acryloxypolyethoxyphenyl)propane, ethylene glycol diacrylate, 1,3-butylene glycol diacrylate, 1,4-butanediol diacrylate, 5-pentanediol diacrylate, 1,6-hexanediol diacrylate, neopentyl glycol diacrylate, diethylene glycol diacrylate, triethylene glycol diacrylate, tetraethylene glycol diacrylate, diacrylates of poly(ethylene glycol)s 200, 400, and 600, dipropylene glycol diacrylate, poly(propylene glycol) diacrylate, a polyester-type diacrylate (MANDA, Nippon Kayaku Co., Ltd.), and compounds expressed as names given by replacing "acrylate" with "methacrylate".

The amount of the crosslinking agent added may be 0.001% or more by mass and 15.000% or less by mass with respect to the polymerizable monomer.

Release Agent

In an embodiment of the present disclosure, a release agent may be contained as one of materials in the toner particles. Examples of the release agent that can be used for the toner particles include petroleum-based waxes, such as paraffin waxes, microcrystalline waxes, petrolatum, and derivatives thereof; montan wax and derivatives thereof; hydrocarbon waxes produced by the Fischer-Tropsch process and derivatives thereof; polyolefin waxes, such as polyethylene, polypropylene, and derivatives thereof; natural waxes, such as carnauba wax, candelilla wax, and derivatives thereof; higher aliphatic alcohols; fatty acids, such as stearic acid and palmitic acid, and compounds thereof; acid amide waxes; ester waxes; ketones; hydrogenated castor oil and derivatives thereof; vegetable waxes; animal waxes, and silicone resins. The derivatives include oxides, block copolymers with vinyl-based monomers, and graft-modified products. The content of the release agent may be 5.0 parts or more by mass and 20.0 parts or less by mass with respect to 100.0 parts by mass of the binder resin or the polymerizable monomer.

Colorant

In the case where a colorant is incorporated into the toner particles in an embodiment of the present disclosure, any of known colorants described below can be used.

Yellow pigments include yellow iron oxide; condensed azo compounds, such as Naples Yellow, Naphthol Yellow S, Hansa Yellow G, Hansa Yellow 10G, Benzidine Yellow G, Benzidine Yellow GR, Quinoline Yellow lake, Permanent Yellow NCG, and Tartrazine Yellow lake; and isoindolinone compounds, anthraquinone compounds, azo metal complexes, methine compounds, and arylamide compounds. Specific examples thereof are as follows:

C.I. Pigment Yellow 12, 13, 14, 15, 17, 62, 74, 83, 93, 94, 95, 109, 110, 111, 128, 129, 147, 155, 168, and 180.

Examples of orange pigments are as follows:

Permanent Orange GTR, Pyrazolone Orange, Vulcan Orange, Benzidine Orange G, Indathrene Brilliant Orange RK, and Indathrene Brilliant Orange GK.

Examples of red pigments include iron red; condensed azo compounds, such as Permanent Red 4R, Lithol Red, Pyrazolone Red, Watching Red, calcium salt, Lake Red C, Lake Red D, Brilliant Carmine 6B, Brilliant Carmine 3B, Eosin Lake, Rhodamine Lake B, and Alizarine Lake; diketopyrrolopyrrole compounds, anthraquinone, quinacridone compounds, basic dye lake compounds, naphthol compounds, benzimidazolone compounds, thioindigo compounds, and perylene compounds. Specific examples thereof are as follows:

C.I. Pigment Red 2, 3, 5, 6, 7, 23, 48:2, 48:3, 48:4, 57:1, 81:1, 122, 144, 146, 166, 169, 177, 184, 185, 202, 206, 220, 221, and 254.

Examples of blue pigments include Alkali Blue Lake; Victoria Blue Lake; copper phthalocyanine compounds and derivatives thereof, such as Phthalocyanine Blue, metal-free Phthalocyanine Blue, partially chlorinated Phthalocyanine Blue, Fast Sky Blue, and Indathrene Blue BG; anthraquinone compounds; and basic dye lake compounds. Specific examples thereof are as follows:

C.I. Pigment Blue 1, 7, 15, 15:1, 15:2, 15:3, 15:4, 60, 62, and 66.

Examples of violet pigments include Fast Violet B and Methyl Violet Lake.

Examples of green pigments include Pigment Green B and Malachite Green Lake. Examples of white pigment include zinc oxide, titanium oxide, antimony white, and zinc sulfide.

Examples of black pigments include carbon black, aniline black, nonmagnetic ferrite, magnetite, and pigment mixture prepared by mixing the foregoing yellow-, red-, and blue-based colorants together to produce a black color. These colorants may be used alone, in combination as a mixture, or in the form of a solid solution.

Attention needs to be given to the polymerization-inhibiting activity and the dispersion medium transferability of the colorant, depending on a method for producing the toner. A surface modification may be performed by treating the surface of the colorant with a substance that does not have polymerization-inhibiting activity, as needed. In particular, most of dyes and carbon blacks have polymerization-inhibiting activity. Thus, care should be exercised in their use.

The colorant content may be 3.0 parts or more by mass and 15.0 parts or less by mass with respect to 100.0 parts by mass of the binder resin or the polymerizable monomer.

Charge Control Agent

The toner particles according to an embodiment of the present disclosure may contain a charge control agent. Known charge control agents may be used. In particular, a charge control agent that is quickly charged and stably maintains a certain amount of electrical charge may be used. In the case where the toner particles are produced by a direct polymerization method, a charge control agent that has low polymerization-inhibiting activity and that is substantially insoluble in an aqueous medium may be used.

Charge control agents that control the toner particles to negative chargeability are exemplified below.

Examples thereof include organometallic compounds and chelate compounds, such as monoazo metal compounds, metal acetylacetonate compounds, and metal compounds of aromatic oxycarboxylic acids, aromatic dicarboxylic acids, oxycarboxylic acids, and dicarboxylic acids. Examples thereof also include aromatic oxycarboxylic acids, aromatic monocarboxylic acids, aromatic polycarboxylic acids, and their metal salts, anhydrides, and esters, and phenol derivatives such as bisphenol. Other examples thereof include urea derivatives, metal-containing salicylic acid-based compounds, metal-containing naphthoic acid-based compounds, boron compounds, quaternary ammonium salts, and calixarene.

Charge control agents that control the toner particles to a positive chargeability are exemplified below.

Examples thereof include nigrosine and nigrosine modified with a fatty acid metal salt; guanidine compounds; imidazole compounds; quaternary ammonium salts, such as tributylbenzylammonium 1-hydroxy-4-naphthosulfonate and tetrabutylammonium tetrafluoroborate; onium salts, such as phosphonium salts, which are analogues of quaternary ammonium salts, and lake pigments thereof; triphenylmethane dyes and lake pigments thereof (examples of laking agents include phosphotungstic acid, phosphomolybdic acid, phosphotungstomolybdic acid, tannic acid, lauric acid, gallic acid, ferricyanide, and ferrocyanide); metal salts of higher fatty acids; and resin-based charge control agents.

These charge control agents may be used alone or in combination of two or more. In the case where a charge control agent containing a metal is used for the toner according to an embodiment of the present disclosure, it should be noted that the resistivity of the metal and the metal content are within the range of the present disclosure. The amount of the charge control agent added may be 0.01 parts or more by mass and 10.00 parts or less by mass with respect to 100.00 parts by mass of the binder resin.

External Additive

The toner particles may be included in the toner according to an embodiment of the present disclosure without using any external additive. To improve the flowability, chargeability, cleaning performance, and so forth, the toner according to an embodiment of the present disclosure may contain a fluidizer, a cleaning aid, and so forth, which are what are called external additives.

Examples of the external additives include fine inorganic oxide particles, such as fine silica particles, fine alumina particles, and fine titanium particles; fine inorganic stearate compound particles, such as fine aluminum stearate particles and fine zinc stearate particles; and fine inorganic titanate compound particles, such as fine strontium titanate particles and fine zinc titanate particles. These may be used alone or in combination of two or more. These fine inorganic particles may be subjected to gloss treatment with a silane coupling agent, a titanium coupling agent, a higher fatty acid, a silicone oil, or the like in order to improve the heat resistance during storage and the environmental stability. The external additive may have a BET specific surface area of 10 $m^2/g$ or more and 450 $m^2/g$ or less.

The BET specific surface area may be determined by a low-temperature gas adsorption method using a dynamic constant pressure method according to a BET method (a BET multipoint method). For example, a specimen is allowed to adsorb nitrogen gas on its surface in a specific surface area analyzer (trade name: Gemini 2375 Ver. 5.0, manufactured by Shimadzu Corporation), and measurement is performed by the BET multipoint method to calculate the BET specific surface area ($m^2/g$).

The total amount of these various external additives is 0.05 parts or more by mass and 5 parts or less by mass and preferably 0.1 parts or more by mass and 3 parts or less by mass with respect to 100 parts by mass of the particles before the external additives are added. The various external additives may be used in combination.

Developer

The toner according to an embodiment of the present disclosure may be used as a magnetic or nonmagnetic mono-component developer and may be mixed with a carrier before being used as a two-component developer.

Examples of the carrier that can be used include magnetic particles containing known materials, for example, metals, such as iron, ferrite, and magnetite, and alloys of these metals and metals such as aluminum and lead. Of these, ferrite particles may be used. As the carrier, for example, a coated carrier including magnetic particles whose surfaces are coated with a coating agent such as a resin or a resin-dispersion carrier including fine magnetic powder dispersed in a binder resin may be used.

The carrier preferably has a volume-average particle diameter of 15 μm or more and 100 μm or less and more preferably 25 μm or more and 80 μm or less.

Method for Producing Toner Particles

As a method for producing the toner particles, a known method may be employed. For example, a kneading and pulverization method or wet production method may be employed. From the viewpoint of achieving uniform particle diameter and good form controllability, the wet production method may be employed. Examples of the wet production method include a suspension polymerization method, a dissolution suspension method, an emulsion polymerization and coagulation method, and an emulsion aggregation method. In an embodiment of the present disclosure, the emulsion aggregation method may be employed.

The reason for this is that:

(i) the polyvalent metal element is easily ionized in an aqueous medium;

(ii) the polyvalent metal element is easily incorporated into toner particles during the aggregation of the binder resin; and (iii) because a silanol group is present when the organosilicon polymer is formed in an aqueous medium, the metal crosslinking between the silanol group of the organosilicon polymer and the binder resin is easily formed.

In the emulsion aggregation method, materials, such as fine particles of the binder resin and the colorant, are dispersed and mixed in an aqueous medium containing a dispersion stabilizer. The aqueous medium may contain a surfactant. A flocculant is added to the mixture to aggregate the materials to a target toner particle diameter. The fine resin particles are allowed to coalesce subsequent to or at the same of the aggregation. The form is controlled by heat, as needed, thereby forming the toner particles. Here, the fine particles of the binder resin may be formed of composite particles that are composed of resins having different compositions, each of the composite particles having a multilayer structure including two or more layers. For example, the composite particles may be produced by any of an emulsion polymerization method, a miniemulsion polymerization method, a phase inversion emulsification method, and so forth or in combination of some production methods.

In the case where an internal additive is incorporated into the toner particles, the fine resin particles may contain the internal additive. An internal additive particle dispersion containing the internal additive alone is prepared, and coaggregation of the fine internal additive particles and the fine resin particles may be performed at the time of the aggregation of the fine resin particles. Toner particles including layers that have different compositions may be produced by addition of fine resin particles having different compositions at different times during the aggregation.

Examples of the dispersion stabilizer that may be used are as follows. Examples of an inorganic dispersion stabilizer include tricalcium phosphate, magnesium phosphate, zinc phosphate, aluminum phosphate, calcium carbonate, magnesium carbonate, calcium hydroxide, magnesium hydroxide, aluminum hydroxide, calcium metasilicate, calcium sulfate, barium sulfate, bentonite, silica, and alumina.

Examples of an organic dispersion stabilizer include polyvinyl alcohol), gelatin, methyl cellulose, hydroxypropyl methylcellulose, ethyl cellulose, a sodium salt of carboxymethyl cellulose, and starch.

As the surfactant, a known cationic surfactant, anionic surfactant, or nonionic surfactant may be used. Specific examples of the cationic surfactant include dodecylammonium bromide, dodecyltrimethylammonium bromide, dodecylpyridinium chloride, dodecylpyridinium bromide, and hexadecyltrimethylammonium bromide. Specific examples of the nonionic surfactant include dodecyl polyoxyethylene ether, hexadecyl polyoxyethylene ether, nonylphenyl polyoxyethylene ether, lauryl polyoxyethylene ether, sorbitan monooleate polyoxyethylene ether, styrylphenyl polyoxyethylene ether, and monodecanoyl sucrose. Specific examples of the anionic surfactant include fatty acid soaps, such as sodium stearate and sodium laurate, sodium lauryl sulfate, sodium dodecylbenzenesulfonate, and sodium polyoxyethylene (2) lauryl ether sulfate.

The toner may have a weight-average particle diameter of 3.0 μm or more and 10.0 μm or less in view of an image with high definition and high resolution. The particle diameter of the toner may be measured by an aperture impedance method. For example, the particle diameter of the toner may be measured and calculated using a Multisizer 3 Coulter Counter and bundled dedicated software Beckman Coulter Multisizer 3 Version 3.51 (manufactured by Beckman Coulter, Inc).

The toner preferably has an average circularity of 0.930 to 1.000 and more preferably 0.950 to 0.995 from the viewpoint of improving the transfer efficiency. In an embodiment of the present disclosure, the average circularity of the toner can be measured and calculated using an FPIA-3000 (from Sysmex Corporation).

Method for Measuring Physical Properties of Toner Method for Separating THF-Insoluble Matter from Toner Particles for NMR Measurement Tetrahydrofuran (THF)-insoluble matter from the toner particles is separated as described below.

First, 10.0 g of the toner particles are charged into a filter paper thimble (No. 86R, manufactured by Toyo Roshi Kaisha, Ltd.) and are subjected to Soxhlet extraction for 20 hours with 200 mL of THF serving as a solvent. The resulting filter residue in the filter paper thimble is dried at 40° C. for several hours under vacuum to provide THF-insoluble matter of the toner particles for NMR measurement. If the toner particles contain a magnetic material, the magnetic material is separated with a magnet during extraction or the like.

If the toner particles have been subjected to surface treatment with an external additive or the like, the external additive is removed by a method described below to provide toner particles.

First, 160 g of sucrose (manufactured by Kishida Chemical Co., Ltd.) is added to 100 mL of deionized water and dissolved in a hot-water bath to prepare a concentrated sucrose solution. To a centrifuge tube are added 31 g of the concentrated sucrose solution and 6 mL of Contaminon N (a 10% by mass aqueous neutral detergent with a pH of 7 for cleaning precision measuring instruments composed of a nonionic surfactant, an anionic surfactant, and an organic builder, manufactured by Wako Pure Chemical Industries, Ltd.), thereby preparing a dispersion. To the dispersion, 1.0 g of the toner is added. The agglomerates of the toner are triturated with a spatula or the like.

The centrifuge tube is shaken with a shaker at a rate of 350 strokes per minute (spm) for 20 minutes. After the shaking, the solution is transferred into a glass tube for a swing rotor (50 mL) and subjected to centrifugation with a centrifuge at 3500 rpm for 30 minutes. With this operation, toner particles are separated from the external additive detached from the toner particles. The sufficient separation of the toner from the aqueous solution is visually verified. The toner, which is separated into the uppermost layer, is collected with a spatula or the like. The collected toner is filtered with a vacuum filter and dried with a drier for 1 hour or more to give toner particles. This operation is repeated several times to collect the amount of toner particles required.

Method for Identifying Partial Structure Represented by Formula (1)

The partial structure represented by formula (1) in the organosilicon polymer in the toner particles is identified by methods described below.

The presence or absence of the hydrocarbon group represented by R in formula (1) is identified by $^{13}$C-NMR. Details of the partial structure represented by formula (1) are identified by $^{1}$H-NMR, $^{13}$C-NMR, and $^{29}$Si-NMR. An instrument and measurement conditions used are listed below.

Measurement conditions
Instrument: AVANCE III 500 from BRUKER
Probe: 4 mm MAS BB/1H
Measurement temperature: room temperature
Sample spinning rate: 6 kHz
Sample: 150 mg of the measurement sample (THF-insoluble matter of the toner particles for NMR measurement) is charged into a sample tube having a diameter of 4 mm.

The presence or absence of the hydrocarbon group denoted by R in formula (1) is checked by this method. The structure of formula (1) is identified as being "present" when a signal is confirmed.

Measurement conditions in $^{13}$C-NMR (solid)
Measurement nuclear frequency: 125.77 MHz
Reference substance: Glycine (external reference: 176.03 Ppm)
Observation width: 37.88 kHz
Measurement method: CP/MAS
Contact time: 1.75 ms
Repetition time: 4 s
Number of accumulations: 2048
LB value: 50 Hz $^{29}$Si-NMR (solid) measurement method
Measurement conditions
Instrument: AVANCE III 500 from BRUKER
Probe: 4 mm MAS BB/1H
Measurement temperature: room temperature
Sample spinning rate: 6 kHz
Sample: 150 mg of the measurement sample (THE-insoluble matter of the toner particles for NMR measurement) is charged into a sample tube having a diameter of 4 mm.
Measurement nuclear frequency: 99.36 MHz
Reference substance: DSS (external reference: 1.534 ppm)
Observation width: 29.76 kHz
Measurement method: DD/MAS, CP/MAS
$^{29}$Si 90° pulse width: 4.00 μs at −1 dB
Contact time: 1.75 ms to 10 ms
Repetition time: 30 s (DD/MASS), 10 s (CP/MAS)
Number of accumulations: 2048
LB value: 50 Hz Method for calculating percentage of partial structure represented by formula (1) (structure (1)) and structure (structure X2) in which number of silicon-bonded $O_{1/2}$ is 2.0 in organosilicon polymer in toner particles Method for identifying and quantifying structure (1), structure X1, structure X2, structure X3, and structure X4

Partial structures (1), X1, X2, X3, and X4 can be identified by $^{1}$H-NMR, $^{13}$C-NMR, and $^{29}$Si-NMR.

After the $^{29}$Si-NMR measurement of the THF-insoluble matter in the toner particles, peaks of silane components having different substituents and bonding groups in the toner particles are separated by curve fitting into structure X4 in which the number of silicon-bonded $O_{1/2}$ is 4.0 and which is represented by general formula (X4) below; structure X3 in which the number of silicon-bonded $O_{1/2}$ is 3.0 and which is represented by general formula (X3) below; structure X2 in which the number of silicon-bonded $O_{1/2}$ is 2.0 and which is represented by general formula (X2) below; structure X1 in which the number of silicon-bonded $O_{1/2}$ is 1.0 and which is represented by general formula (X1) below; and the partial structure represented by formula (1). The percentage by mole of each of the components is calculated from the percentage of the area of a corresponding one of the peaks.

(X4)

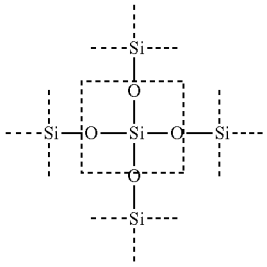

(X3)

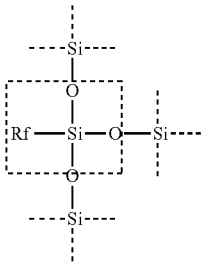

wherein Rf in general formula (X3) represents an organic group, a halogen atom, a hydroxy group, or an alkoxy group bonded to silicon, (X2)

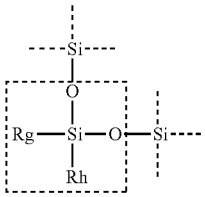

wherein Rg and Rh in general formula (X2) each represent an organic group, a halogen atom, a hydroxy group, or an alkoxy group bonded to silicon, (X1)

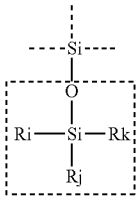

wherein Ri, Rj, and Rk in general formula (X1) each represent an organic group, a halogen atom, a hydroxy group, or an alkoxy group bonded to silicon.

FIG. 1 illustrates an example of curve fitting. Peak separation is performed in such a manner that synthetic peak differences (a) that are differences between synthetic peaks (b) and the measurement results (d) are minimized.

The area of a peak originating from structure X1, the area of a peak originating from structure X2, the area of a peak originating from structure X3, and the area of a peak originating from structure X4 are determined. SX1, SX2, SX3, and SX4 are determined from expressions described below.

In an embodiment of the present disclosure, a silane monomer is identified on the basis of a chemical shift value. In the $^{29}$Si-NMR measurement of the toner particles, the total of the area of the peak originating from structure X1, the area of the peak originating from structure X2, the area of the peak originating from structure X3, and the area of the peak originating from structure X4 is defined as the total peak area, the area of a peak assigned to the monomer component being subtracted from the total peak area.

$$SX1+SX2+SX3+SX4=1.00$$

$$SX1=\{\text{area corresponding to structure } X1/(\text{area corresponding to structure } X1+\text{area corresponding to structure } X2+\text{area corresponding to structure } X3+\text{area corresponding to structure } X4)\}$$

$$SX2=\{\text{area corresponding to structure } X2/(\text{area corresponding to structure } X1+\text{area corresponding to structure } X2+\text{area corresponding to structure } X3+\text{area corresponding to structure } X4)\}$$

$$SX3=\{\text{area corresponding to structure } X3/(\text{area corresponding to structure } X1+\text{area corresponding to structure } X2+\text{area corresponding to structure } X3+\text{area corresponding to structure } X4)\}$$

$$SX4=\{\text{area corresponding to structure } X4/(\text{area corresponding to structure } X1+\text{area corresponding to structure } X2+\text{area corresponding to structure } X3+\text{area corresponding to structure } X4)\}$$

$$S(1)=\{\text{area corresponding to structure (1)}/(\text{area corresponding to structure } X1+\text{area corresponding to structure } X2+\text{area corresponding to structure } X3+\text{area corresponding to structure } X4)\}$$

Chemical shifts of silicon in structures X1, X2, X3, and X4 are listed below.

An example of structure X1 (Ri=Rj=—$OC_2H_5$, Rk=—$CH_3$): −47 ppm.

An example of structure X2 (Rg=—$OC_2H_5$, Rh=—$CH_3$): −56 ppm

An example of structure X3 (R=—$CH_3$): −65 ppm

When structure X4 is present, the chemical shift of silicon therein is described below.

Structure X4: −108 ppm

In an embodiment of the present disclosure, in a chart obtained by subjecting THF-insoluble matter of the toner particles to $^{29}$Si-NMR measurement, the percentage of the area of the peak assigned to the partial structure represented by formula (1) is 20% or more with respect to the total peak area of the organosilicon polymer. Method for measuring average thickness Dav. of surface layer of toner particle and percentage of surface layer with 2.5 nm or less by observation of cross section of toner particle using transmission electron microscope (TEM)

In an embodiment of the present disclosure, cross sections of the toner particles are observed by a method described below.

A specific method for observing cross sections of the toner particles is as follows: The toner particles are sufficiently dispersed in an epoxy resin curable at normal temperature. The resin mixture is cured at 40° C. for two days. A thin-section specimen is cut out from the resulting cured product using a microtome equipped with a diamond blade. A cross section of one toner particle in the specimen is observed using a transmission electron microscope (TEM) (Model: Tecnai TF20XT, manufactured by FEI) at a magnification of ×10,000 to ×100,000.

In an embodiment of the present disclosure, a difference in atomic weight between atoms in the resin and atoms in the organosilicon compound is used. That is, identification is performed using the fact that higher atomic weights result, in brighter images. To enhance a difference in contrast between materials, a ruthenium tetroxide staining method and an osmium tetroxide staining method may be employed.

Each of the particles targeted for the measurement has a circle-equivalent diameter Dtem determined from a TEM photomicrograph of its cross section, the value of the circle-equivalent diameter Dtem being within ±10% of the weight-average particle diameter D4 of the toner particles determined by a method described below.

As described above, a bright-field image of the cross section of the toner particle is taken using the transmission electron microscope (Model: Tecnai TF20XT, manufactured by FEI) at an accelerating voltage of 200 kV. An EF mapping image at the Si—K edge (99 eV) is taken by a three-window method with an EELS detector (Model: GIF Tridiem, manufactured by Gatan, Inc.), and the presence of the organosilicon polymer on the surface layer is checked.

Figure 2:
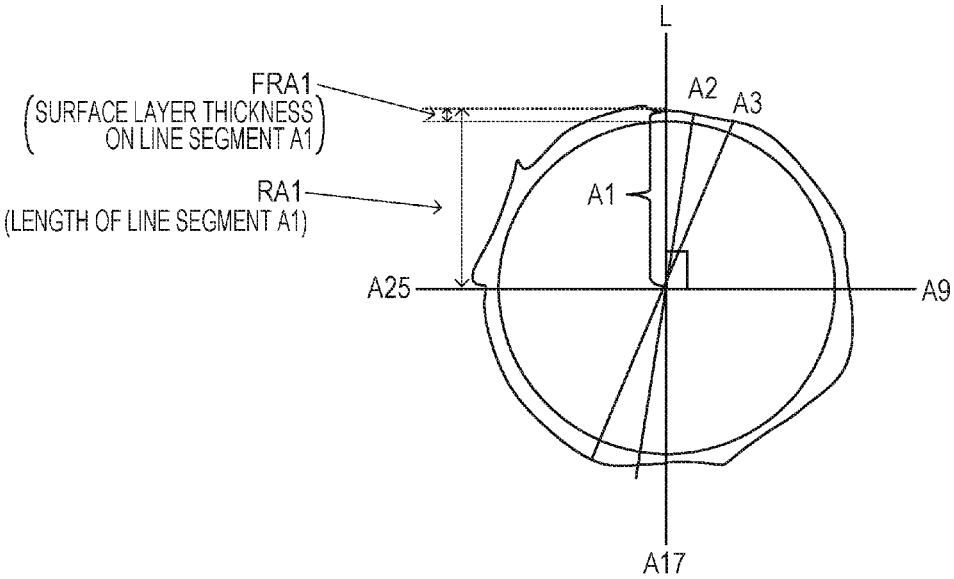
FIG. 2 is a conceptual diagram that defines the thickness of the surface layer containing an organosilicon compound according to an embodiment of the present disclosure.

With respect to one toner particle having a circle-equivalent diameter Dtem within ±10% of the weight-average particle diameter D4 of the toner particles, the long axis L of the cross section of the toner particle is determined, and the midpoint of the long axis L is determined. Line segments are drawn so as to pass through the midpoint and so as to be located 11.25° apart from line segments obtained by bisecting the long axis L. Line segments are further drawn so as to be located 11.25° apart from each other, thereby dividing the cross section of the toner particle into 32 equal portions (see FIG. 2). The thicknesses FRAn (n=1 to 32) of portions of the surface layer on the line segments An (n=1 to 32) extending from the midpoint to the surface layer of the toner particle are measured.

The average thickness Dav. of the surface layers of the toner particles are calculated by a method described below.

First, the average thickness D of the surface layer of one toner particle is calculated from the following equation:

$$D=(\text{total of } FRA1 \text{ to } FRA32)/32$$

This calculation is performed for 10 toner particles. The arithmetic mean of the resulting average thicknesses of the surface layers of 10 toner particles is calculated. The arithmetic mean is used as the average thickness Dav. of the surface layers of the toner particles according to an embodiment of the present disclosure.

The percentage of the surface layers having a thickness of 2.5 nm or less is calculated by a method described below.

First, the percentage of the surface layer having a thickness of 2.5 nm or less of one toner particle is calculated.

$$\text{Percentage of surface layer having thickness of 2.5 nm or less}=\{\{\text{number of } FRAn \text{ equal to or less than 2.5 nm among } FRA1 \text{ to } FRA32\}/32\}\times 100$$

This calculation is performed for 10 toner particles. The arithmetic mean of the resulting percentage values in the 10 toner particles is calculated. The arithmetic mean is used as the percentage of the surface layers having a thickness of 2.5 nm or less of the toner particles according to an embodiment of the present disclosure.

Circle-Equivalent Diameter (Dtem) Determined from. Cross Section of Toner Particle Obtained from Photomicrograph Taken with Transmission Electron Microscope (TEM)

The following method is employed to determine the circle-equivalent diameter (Dtem) from the cross sections of the toner particles in a TEM photomicrograph. First, the circle-equivalent diameter (Dtem) of one toner particle is determined from the cross section in the TEM photomicrograph using the following expression:

$$\text{Circle-equivalent diameter determined from cross section of toner particle in TEM photomicrograph } (Dtem)=(RA1+RA2+RA3+RA4+RA5+RA6+RA7+RA8+RA9+RA10+RA11+RA12+RA13+RA14+RA15+RA16+RA17+RA18+RA19+RA20+RA21+RA22+RA23+RA24+RA25+RA26+RA27+RA28+RA29+RA30+RA31+RA32)/16$$

The circle-equivalent diameters of 10 toner particles are determined. The average of the circle-equivalent diameters is calculated for one particle and used as the circle-equivalent diameter (Dtem) determined from the cross sections of the toner particles.

Density of Silicon Element Present in Surface Layer of Toner Particle (Atomic %)

The density of silicon atoms dSi (atomic %), the density of carbon atoms dC (atomic %), and the density of oxygen atoms dO (atomic %) present in the surface layers of the toner particles are calculated by performing surface composition analysis using electron spectroscopy for chemical analysis (ESCA). An apparatus for ESCA and measurement conditions used in an embodiment of the present disclosure are listed below.

Instrument used: Quantum 2000, manufactured by ULVAC-PHI, Inc.

Measurement conditions of ESCA

X-ray source: Al Kα

X-ray: 100 μm, 25 W, 15 kV

Raster: 300 μm×200

Pass Energy: 58.70 eV

Step Size: 0.125 eV

Neutralizing electron gun: 20 μA, 1 V

Ar ion gun: 7 mA, 10 V

Number of sweeps: 15 for Si, 10 for C, 5 for 0

In an embodiment of the present disclosure, the density of silicon atoms dSi, the density of carbon atoms dC, and the density of oxygen atoms dO (all in atomic %) present in the surface layers of the toner particles are calculated from peak intensities of elements measured using relative sensitivity factors provided by ULVAC-PHI, Inc.

Measurement of Particle Diameter of Toner Particle

A precision particle size distribution analyzer (trade name: Multisizer 3 Coulter Counter) by an aperture impedance method and dedicated software (trade name: Beckman. Coulter Multisizer 3 Version 3.51, manufactured by Beckman Coulter, Inc.) are used. Measurement is performed at 25,000 effective measuring channels with an aperture diameter of 100 μm. The resulting measurement data is analyzed, and the particle diameter is calculated.

As an aqueous electrolyte solution used for the measurement, about 1% by mass solution of sodium chloride (reagent grade) in ion-exchanged water, for example, an ISOTON II (trade name, manufactured by Beckman Coulter, Inc.), may be used.

The dedicated software is set up as described below prior to the measurement and analysis.

On the "Standard operation mode (SOM) setting screen" of the dedicated software, the total count number in control mode is set at 50,000 particles, the number of measurements is set at 1, and the Kd value is set at a value obtained with "standard particles 10.0 μm" (manufactured by Beckman Coulter, Inc). A threshold/noise level measurement button is pushed to automatically set the threshold and noise level. The current is set at 160 μA. The gain is set at 2. Isoton II (trade name) is chosen as an electrolyte solution. Flushing of an aperture tube after measurement is checked.

On the "Conversion of pulse into particle diameter setting screen" of the dedicated software, the bin interval is set at logarithmic particle diameter, the particle diameter bin is set at 256 particle diameter bins, and the particle diameter range is set at 2 μm or more and 60 μm or less.

The specific measurement method is described below.

(1) Into a special 250-mL round-bottom glass beaker for Multisizer 3, about 200 mL of the aqueous electrolyte solution is charged. The glass beaker is placed on a sample stand. The electrolyte solution is stirred counterclockwise with a stirrer rod at 24 revolutions per second. Soiling and air bubbles in the aperture tube are removed using the "Aperture flushing" function of the analysis software.

(2) About 30 mL of the aqueous electrolyte solution is charged into a 100-mL flat-bottom glass beaker. To the electrolyte solution is added about 0.3 mL of Contaminon N (trade name, 10% by mass aqueous solution of neutral detergent for cleaning precision measuring instruments, manufactured by Wako Pure Chemical Industries, Ltd.) diluted 3 times by mass with ion-exchanged water.

(3) A predetermined amount of ion-exchanged water and about 2 mL Contaminon N (trade name) are charged into a water tank of an ultrasonic disperser (trade name: Ultrasonic Dispersion System Tetora 150, manufactured by Nikkaki-Bios Co., Ltd.) that has an electrical output of 120 W and that includes two built-in oscillators having an oscillation frequency of 50 kHz and a phase difference of 180°.

(4) The beaker provided in item (2) is placed in a beaker-holding hole in the ultrasonic disperser, and the ultrasonic disperser is operated. The height level of the beaker is adjusted in such a manner that the resonance state of the surface of the aqueous electrolyte solution in the beaker is maximal.

(5) About 10 mg of a toner (particles) is gradually added to the aqueous electrolyte solution and dispersed while the aqueous electrolyte solution in the beaker prepared in item (4) is irradiated with ultrasonic waves. The ultrasonic dispersion treatment is continued for another 60 seconds. The water temperature in the water tank is appropriately controlled to 10° C. or higher and 40° C. or lower during the ultrasonic dispersion.

(6) The aqueous electrolyte solution, containing the toner (particles) dispersed therein, in item (5) is added dropwise using a pipette to the round-bottom beaker placed on the sample stand in item (1) in such a manner that the measurement concentration is about 5%. Measurement is continued until the number of particles measured reaches 50,000.

(7) The measured data are analyzed using the dedicated software attached to the analyzer to determine the weight-average particle diameter (D4). The weight-average particle diameter (D4) is the "average diameter" on the analysis/volume statistics (arithmetic mean) screen in the setting of graph/% by volume in the dedicated software. The number-average particle diameter (D1) is the "Average diameter" on the "Analysis/number statistics (arithmetic mean)" screen in the setting of graph/% by number in the dedicated software.

Method for Measuring Average Circularity of Toner (Particles)

The average circularity of the toner (particles) is measured with a flow particle imaging instrument (Model: FPIA-3000, from Sysmex Corporation) under the measurement and analysis conditions for calibration.

An appropriate amount of a surfactant alkylbenzene sulfonate serving as a dispersant is added to 20 mL of ion-exchanged water, and then 0.02 g of a measurement specimen is added thereto. The specimen is subjected to dispersion treatment for 2 minutes with a table-Lop ultrasonic cleaner/disperser (Model: VS-150, manufactured by VELVO-CLEAR) having an oscillation frequency of 50 kHz and an electrical output of 150 W, thereby preparing a dispersion for measurement. The dispersion is appropriately cooled to 10° C. or higher and 40° C. or lower during the dispersion treatment.

The flow particle imaging instrument equipped with a standard objective lens (magnification: ×10) is used for the measurement. A particle sheath (PSE-900A, from. Sysmex Corporation) is used as a sheath liquid. In an HPF measurement mode and a total count mode, 3000 toner particles in the dispersion prepared according to the foregoing procedure are measured. The binarization threshold in particle analysis is 85%. The particle diameter to be analyzed is limited to a circle-equivalent diameter of 1.98 μm or more and 19.92 μm or less. The average circularity of the toner (particles) is determined.

Prior to measurement, automatic focusing is adjusted with standard latex particles (for example, 5100A (trade name), manufactured by Duke Scientific, diluted with ion-exchanged water). Focusing can be adjusted every 2 hours after the start of measurement.

X-Ray Fluorescence

The X-ray fluorescence of elements is measured according to JIS K 0119-1969. The measurement is specifically described below.

As a measuring instrument, a wavelength-dispersive X-ray fluorescence analyzer (Model: Axios, manufactured by PANalytical) and bundled dedicated software (Model: Super Q ver. 4.0F, manufactured by PANalytical) for setting the measurement, conditions and analyzing the measurement data are used. The anode of an X-ray tube is composed of Rh. The measurement atmosphere is a vacuum. The measurement diameter (collimator mask diameter) is 27 mm. The measurement time is 10 seconds. For measuring light elements, a proportional counter (PC) is used for detection. For measuring heavy elements, a scintillation counter (SC) is used for detection.

A pellet having a thickness of 2 mm and a diameter of 39 mm is used as specimen for measurement, the pellet being formed by charging 4 g of the toner particles into a special aluminum ring for pressing, levelling the surface of the toner, and compressing the toner with a pellet-forming compressor (Model: BRE-32, manufactured by Maekawa Testing Machine Mfg. Co., Ltd.) at 20 MPa for 60 seconds.

The measurement is performed under the foregoing conditions. Elements are identified on the bases of X-ray peak positions. The counting rate (unit: Kcps) corresponding to the number of X-ray photons per unit time is measured.

Measurement of Organosilicon Polymer Content in Toner Particle

The organosilicon polymer content is measured with a wavelength-dispersive X-ray fluorescence analyzer (Model: Axios, manufactured by PANalytical) and bundled dedicated software (Model: Super Q ver. 4.0F, manufactured by PANalytical) for setting the measurement conditions and analyzing the measurement data. The anode of an X-ray tube is composed of Rh. The measurement atmosphere is a vacuum. The measurement diameter (collimator mask diameter) is 27 mm. The measurement time is 10 seconds. For measuring light elements, a proportional counter (PC) is used for detection. For measuring heavy elements, a scintillation counter (SC) is used for detection.

A pellet having a thickness of 2 mm and a diameter of 39 mm is used as specimen for measurement, the pellet being formed by charging 4 g of the toner particles into a special aluminum ring for pressing, levelling the surface of the toner, and compressing the toner with a pellet-forming compressor (Model: BRE-32, manufactured by Maekawa Testing Machine Mfg. Co., Ltd.) at 20 MPa for 60 seconds.

First, 0.5 parts by mass of a fine silica ($SiO_2$) powder is added to 100 parts by mass of the toner particles that do not contain the organosilicon polymer. The resulting mixture is sufficiently mixed using a coffee mill. Similarly, 5.0 parts by mass and 10.0 parts by mass of the fine silica powder are mixed with two sets of the toner particles. These are used as specimens for the preparation of a calibration curve.

Each of the specimens is formed into a pellet for the preparation of a calibration curve using the pellet-forming compressor in the same way as above. The counting rate (unit: cps) of Si-K$\alpha$ radiation observed at a diffraction angle ($2\theta$) of 109.08° when PET is used as an analyzing crystal is measured. The accelerating voltage and current of the X-ray generator used in the measurement are 24 kV and 100 mA, respectively. A linear calibration curve with the counting rate of the X-ray on the vertical axis and the amount of $SiO_2$, which is added to each of the specimens used for the preparation of the calibration curve, on the horizontal axis is formed.

The toner targeted for analysis is formed into a pellet with the pellet-forming compressor in the same way as above. The counting rate of Si-K$\alpha$ radiation is measured. The organosilicon polymer content of the toner is determined from the calibration curve.

EXAMPLES

While the present disclosure will be described in more detail on the basis of examples below, the present disclosure is not limited to these examples. Hereinafter, parts indicate parts by mass.

Example 1

Preparation of Binder Resin Particle Dispersion

First, 89.5 parts of styrene, 9.2 parts of butyl acrylate, 1.3 parts of acrylic acid serving as a monomer that imparts a carboxy group, and 3.2 parts of n-lauryl mercaptan were mixed together to prepare a solution. A solution of 1.5 parts of Neogen RK (from Dai-ichi Kogyo Seiyaku Co., Ltd.) in 150 parts of ion-exchanged water was added to the solution and dispersed. A solution of 0.3 parts of potassium persulfate in 10 parts of ion-exchanged water was added to the resulting mixture while the mixture was slowly stirred for 10 minutes. After the system was filled with nitrogen, the mixture was subjected to emulsion polymerization at 70° C. for 6 hours. Upon completion of the polymerization, the reaction mixture was cooled to room temperature. The addition of ion-exchanged water to the reaction mixture resulted in a resin particle dispersion having a solid content of 12.5% by mass and a median diameter of 0.2 μm on a volume basis. A resin in the resin particles contained a carboxy group originating from acrylic acid.

Preparation of Release Agent Dispersion

First, 100 parts of a release agent (behenyl behenate, melting point: 72.1° C.) and 15 parts of Neogen RK were mixed with 385 parts of ion-exchanged water. The mixture was dispersed for about 1 hour with a wet jet mill (Model: JN 100, from Jokoh Co., Ltd.) to provide a release agent dispersion. The concentration of the release agent dispersion was 20% by mass.

Preparation of Colorant Dispersion

First, 100 parts of carbon black (Nipex 35, from Orion Engineered Carbons) serving as a colorant and 15 parts of Neogen RK were mixed with 885 parts of ion-exchanged water. The mixture was dispersed for about 1 hour with a wet jet mill (Model: JN 100) to provide a colorant dispersion.

Production Example of Toner 1

First, 265 parts of the resin particle dispersion, 10 parts of the release agent dispersion, and 10 parts of the colorant dispersion were dispersed with a homogenizer (Model: Ultra-Turrax T50, from IKA). The temperature in the vessel was adjusted to 30° C. under stirring. An aqueous solution of 1 mol/L sodium hydroxide was added to the mixture to adjust the pH to 8.0 (pH adjustment 1). An aqueous solution containing 0.3 parts of magnesium sulfate, serving as a flocculant, dissolved in 10 parts of ion-exchanged water was added thereto over a period of 10 minutes at 30° C. under stirring. The mixture was allowed to stand for 3 minutes, a temperature rise was started. The mixture was heated to 50° C. to form associated particles. The particle diameter of the associated particles was measured with a Multisizer 3 Coulter Counter (registered trademark, manufactured by Beckman Coulter, Inc.) in that state. When the weight-average particle diameter was 6.5 μm, 0.9 parts of sodium chloride and 5.0 parts of Neogen RK were added thereto to terminate the particle growth.

After 0.5 parts of magnesium sulfate serving as an additional additive metal compound was added to the mixture, 14.0 parts of methyltriethoxysilane, which is an organosilicon compound, was added thereto. An aqueous solution of 1 mol/L sodium hydroxide was added to the mixture to adjust the pH to 9.0 (pH adjustment 2). The mixture was then heated to 95° C. The associated particles were subjected to coalescence and spheronization while the organosilicon compound was subjected to hydrolysis and condensation under stirring at 95° C. A temperature drop was started when the average circularity reached 0.980. After the temperature was reduced to 85° C., an aqueous solution of 1 mol/L sodium hydroxide was added to the mixture to adjust the pH to 9.5 (pH adjustment 3). The mixture was stirred for 180 minutes to allow the condensation to proceed further. The mixture was then cooled to provide toner particle dispersion 1.

Hydrochloric acid was added to the toner particle dispersion 1 to adjust the pH to 1.5 or less. The mixture was stirred for 1 hour, allowed to stand, and subjected to solid-liquid separation with a pressure filter to provide a toner cake. The toner cake was reslurried with ion-exchanged water into a dispersion. The dispersion was subjected to solid-liquid separation with the foregoing filter. After the reslurrying and the solid-liquid separation were repeated until the filtrate had an electric conductivity of 5.0 μS/cm or less, final solid-liquid separation was performed to provide a toner cake. The resulting toner cake was dried with a flash dryer (Model: Flash Jet Dryer, from Seishin Enterprise Co., Ltd). The drying was performed at a blowing temperature of 90° C. and a dryer outlet temperature of 40° C. The toner cake feed rate was adjusted, depending on the water content of the toner cake, in such a manner that the outlet temperature was not deviated from 40° C. A fine powder and a coarse powder were removed with a multi-division classifier that utilizes the Coanda effect to provide toner particles 1. Silicon mapping on cross sections of toner particles 1 during TEM observation revealed that surface layers containing an organosilicon polymer were formed on surfaces of the particles and that the percentage of line segments on which the thickness of the surface layers containing the organosilicon polymer was 2.5 nm or less was 20.0% or less. In this example, the toner particles 1 were used as toner 1 without adding an external additive. Table 2 lists the average thickness of the surface layers and the percentage of the surface layers having a thickness of 2.5 nm or less of toner 1.

Methods by which toner 1 was evaluated are described below.

Evaluation of Developability

Into a toner cartridge for a tandem-mode laser-beam printer manufactured by CANON KABUSHIKI KAISHA, 220 g of a toner to be evaluated was charged. The toner cartridge was allowed to stand for 24 hours in a high-temperature and high-humidity (30.0° C./80% RH) environment (hereinafter, referred to as an "HH environment"), a normal-temperature and normal-humidity (25° C./50% RH) environment (hereinafter, referred to as an "NN environment"), or a low-temperature and low-humidity (10° C./15% RH) environment (hereinafter, referred to as an "LL environment"). The toner cartridge that had been allowed to stand for 24 hours was mounted on the printer LBP 9600C. images were output on 1000 sheets of A4-size paper in the transverse direction at a printing ratio of 35.0% in the HH and NN environments and at a printing ratio of 1.0% for the LL environment. The following evaluations were performed in the environments.

Evaluation of Fogging in HH Environment

In the HH environment, images having a printing ratio of 35.0% were output on 1000 sheets, and then images having a printing ratio of 0% were output. The degree of whiteness of a white portion of each of the output blank images and the degree of whiteness of recording paper were measured with a reflectometer (Tokyo Denshoku Co., Ltd). The fogging density (%) was calculated from a difference in degree of whiteness therebetween. The fogging density was evaluated according to evaluation criteria described below. A4-size sheets of paper having a basis weight of 70 g/m$^2$ were used as recording paper. The printing was performed in the transverse direction of the A4-size paper.

A: less than 1.0%

B: 1.0% or more and less than 1.5%

C: 1.5% or more and less than 2.0%

D: 2.0% or more and less than 2.5%

E: 2.5% or more

Evaluation of Development Endurance in NN Environment

In the NN environment, after images having a printing ratio of 35.0% were output on 1000 sheets, a mixed image including a halftone image (toner laid-on level: 0.25 mg/cm$^2$) on a leading edge half and a solid image (toner laid-on level: 0.40 mg/cm$^2$) on a trailing edge half was output. The resulting mixed image was evaluated according to evaluation criteria described below. A4-size sheets of paper having a basis weight of 70 g/m$^2$ were used as recording paper. The printing was performed in the transverse direction of the A4-size paper. Surfaces of a developing roller and a photosensitive drum were visually observed after the image output.

A: No soiling is observed on the developing roller or the photosensitive drum. A vertical streak in the conveyance direction and dots having different densities are not observed on the image.

B: One or two fine circumferential streaks are observed on the developing roller, or one or two melt deposits are observed on the photosensitive drum. However, a vertical streak in the conveyance direction and dots having different densities are not observed on the image.

C: Three or more and five or less fine circumferential streaks are observed on the developing roller, three or more and five or less melt deposits are observed on the photosensitive drum, or a faint vertical, streak in the conveyance direction and dots having only slightly different densities are observed on the image.

D: Six or more and 20 or less fine circumferential streaks are observed on the developing roller, six or more and 20 or less melt deposits are observed on the photosensitive drum, or a clear vertical streak in the conveyance direction and dots having clearly different densities are observed on the image.

E: Twenty-one or more fine circumferential streaks are observed on the developing roller, 21 or more melt deposits are observed on the photosensitive drum, or a marked vertical streak in the conveyance direction and dots having significantly different densities are observed on the image.

Evaluation of Ghost in LL Environment

In the LL environment, images having a printing ratio of 1.0% were output on 1000 sheets. Subsequently, images in which longitudinal solid black lines each having a width of 3 cm and longitudinal blank lines each having a width of 3 cm were alternately arranged were continuously output on 10 sheets. Then a halftone image was output on one sheet. The evaluation of a ghost was performed by visually observing a history of the preceding image left on the halftone image. When the halftone image was output, the halftone image was adjusted so as to have a reflection density of 0.4 (a Macbeth densitometer equipped with an SPI filter, manufactured by Macbeth Corp).

A: No history of the preceding image is observed.

B: A minor history of the preceding image is observed in a portion of the halftone image.

C: A history of the preceding image is observed in a portion of the halftone image.

D: A history of the preceding image is observed in the entire halftone image.

Evaluation of Storage Stability

Into a 100-mL glass vessel, 10 g of the toner was charged. The toner was allowed to stand at a temperature of 50° C. and a humidity of 20% for 15 days and then visually checked.

A: The toner remains unchanged.

B: Aggregates are present but easily desegregated.

C: Aggregates that are not easily desegregated are present.

D: The toner has no flowability.

E: Apparent caking occurs.

Measurement of Triboelectric Charge Quantity of Toner

Into a 500-mL plastic bottle equipped with a cap, 276 g of a standard carrier for a negatively chargeable toner (trade name: N-01, from The Imaging Society of Japan) and 24 g of a toner to be evaluated were charged. The mixture was shaken with a shaker (YS-LD: manufactured by Yayoi. Co., Ltd.) at a rate of four strokes per second for 1 minute to provide a two-component developer. Then 30 g of the two-component developer was transferred to each of insulating 50-mL plastic containers. The resulting samples were allowed to stand in the HH environment and the LL environment for 5 days for conditioning. To evaluate the rise properties of charging and leakage in the HH environment, shaking was performed with the foregoing shaker at a rate of 200 strokes per minute for 30 seconds. To evaluate excessive charging in the LL environment, shaking was performed with the foregoing shaker at a rate of 200 strokes per minute for 600 seconds. Then the amount of electrical charge was measured by a method described below.

The two-component developer was charged into a metal container equipped with a conductive screen on the bottom thereof, the conductive screen having 20-μm openings. The metal container was sucked with an aspirator. A difference in mass before and after the suction and the potential stored in a capacitor coupled to the container were measured. At this time, the suction force was 2.0 kPa. The triboelectric charge quantity of the toner particles or toner was calculated from the difference in mass before and after the suction, the potential stored, and the capacitance of the capacitor using the following expression:

$$Q=(A\times B)/(W1-W2)$$

where

Q (mC/kg): the triboelectric charge quantity of the toner particles or toner

A (μF): the capacitance of the capacitor

B (V): the difference in potential stored in the capacitor

W1−W2 (kg): the difference in mass before and after the suction

Strength of Surface Layer

If the surface layers have low strength, shearing by an ultrasonic disperser or the like causes the detachment of the surface layers and the chipping of the toner particles, thereby increasing small-particle-diameter particles having a small perimeter. The frequency of the number of particles having a small perimeter is calculated, and the resulting frequency is used as an index of the strength of the surface layers. Note that a lower frequency of the number of particles having a small perimeter indicates higher strength of the surface layers.

A flow particle imaging instrument (Model: FPIA-3000, from Sysmex Corporation) and an autosampler designed for FPIA-3000, the autosampler having the function of automatically dispersing a sample, (from Sysmex Corporation) were used as measurement instruments. Bundled dedicated software was used for the setting of measurement conditions and the analysis of measurement data.

A high-power image pick-up unit (objective lens: LUCPLFLN, magnification: ×20, numerical aperture: 0.40) was used for measurement. A focus adjustment was performed with 1.0-μm-diameter polystyrene latex particles 5100A (from Duke Scientific Corp.) prior to measurement. A particle sheath (PSE-900A, from Sysmex Corporation) was used as a sheath liquid. Autosampler conditions were as follows: the amount of a dispersant dispensed: 0.5 mL, the amount of the particle sheath dispensed: 10 mL, shaking intensity: 80%, shaking time: 30 seconds, ultrasound irradiation intensity: 100%, ultrasound irradiation time: 600 seconds, the number of revolutions of a propeller: 500 rpm, and the agitation time with the propeller: 600 seconds. About 40 mg of a dry toner was weighed as a sample on a beaker for the autosampler and placed on the autosampler. Measurement was performed in an HPF measurement mode at a total count of 2000. The frequency of the number of particles having a perimeter of 6.3 μm or less was analyzed on the basis of the measurement results using the bundled software.

Table 2 lists the analytical results of toner 1 using ESCA, NMR, X-ray fluorescence, and TEM. Table 3 lists the evaluation results.

Example 2

Toner 2 was produced in the same manner as the production example of toner 1, except that phenyltriethoxysilane was used as the organosilicon compound added and that the amount of the organosilicon compound added was changed as listed in Table 1. Table 2 lists the analytical results of toner 2. Table 3 lists the evaluation results.

Example 3

Toner 3 was produced in the same manner as the production example of toner 1, except that the amount of the organosilicon compound added and the pH value after the pH adjustment were changed as listed in Table 1. Table 2 lists the analytical results of toner 3. Table 3 lists the evaluation results.

Examples 4 to 8

Toners 4 to 8 were produced in the same manner as the production example of toner 1, except that the pH values adjusted in the pH adjustment were changed as listed in Table 1. Table 2 lists the analytical results of toners 4 to 8. Table 3 lists the evaluation results.

Examples 9 to 14

Toners 9 to 14 were produced in the same manner as the production example of toner 1, except that the types and amounts of the flocculants and the additional additive metal compounds added were changed as listed in Table 1. Table lists the analytical results of toners 9 to 14. Table 3 lists the evaluation results.

Example 15

Toner 15 was produced in the same manner as the production examples of toner 1, except that 89.5 parts of styrene, 10.5 parts of butyl acrylate, and 3.2 parts of n-lauryl mercaptan were charged in "Preparation of binder resin particle dispersion" in Example 1 without using acrylic acid serving as a monomer that imparts a carboxy group and that the type and amount of the flocculant and the additional additive metal compound added were changed as listed in Table 1. Table 2 lists the analytical results of toner 15. Table 3 lists the evaluation results.

Examples 16 to 30

Toners 16 to 30 were produced in the same manner as the production example of toner 1, except that the types and amounts of the flocculants and the additional additive metal compounds were changed as listed in Table 1. Table 2 lists the analytical results of toners 16 to 30. Table 3 lists the evaluation results.

Examples 31 to 34

Toners 31 to 34 were produced in the same manner as the production example of toner 1, except that the amounts of the organosilicon compound added were changed as listed in Table 1. Table 2 lists the analytical results of toners 31 to 34. Table 3 lists the evaluation results.

Example 35

Toner 35 was produced in the same manner as the production example of toner 1, except that hexyltriethoxysilane was used as the organosilicon compound added. Table 2 lists the analytical results of toner 35. Table 3 lists the evaluation results.

Comparative Example 1

Comparative toner 1 was produced in the same manner as the production example of toner 1, except that no organosilicon compound was added. Table 2 lists the analytical results of comparative toner 1. Table 3 lists the evaluation results.

Comparative Example 2

Comparative toner 2 was produced in the same manner as the production example of toner 1, except that octyltriethoxysilane was used as the organosilicon compound added. Table 2 lists the analytical results of comparative toner 2. Table 3 lists the evaluation results.

Comparative Example 3

Comparative toner 3 was produced in the same manner as the production example of toner 1, except that phenyltriethoxysilane was used as the organosilicon compound added and that the amount of the organosilicon compound and the pH value adjusted in the pH adjustment were changed as listed in Table 1, Table 2 lists the analytical results of comparative toner 3. Table 3 lists the evaluation results.

Comparative examples 4 and 5

Comparative examples 4 and 5 were produced in the same manner as the production example of toner 1, except that the amounts of the organosilicon compound added and the pH values adjusted in the pH adjustment were changed as listed in Table 1, Table 2 lists the analytical results of comparative toners 4 and 5. Table 3 lists the evaluation results.

Comparative Examples 6 to 12

Comparative examples 6 to 12 were produced in the same manner as the production example of toner 1, except that the types and amounts of the flocculants and the additional additive metal compounds added were changed as listed in Table 1. Table 2 lists the analytical results of comparative toners 6 to 12. Table 3 lists the evaluation results. Regarding the results of X-ray fluorescence analysis in Comparative examples 6 to 8, because no polyvalent metal element was detected, the value of potassium in a compound used as the flocculant and the additional additive metal compound is described.

All the resulting toners had a weight-average particle diameter (D4) of 6.3 to 6.7 atm and an average circularity of 0.978 to 0.983.

TABLE 1

| | Amount of organosilicon | Flocculant | | Additional additive metal compound | | Adjusted pH | |
|---|---|---|---|---|---|---|---|
| | compound added (parts) | Type | Amount (parts) | Type | Amount (parts) | pH adjustment 2 | pH adjustment 3 |
| Example 1 | 14.0 | magnesium sulfate | 0.30 | magnesium sulfate | 0.50 | 9.00 | 9.50 |
| Example 2 | 6.0 | magnesium sulfate | 0.30 | magnesium sulfate | 0.50 | 9.00 | 9.50 |
| Example 3 | 16.0 | magnesium sulfate | 0.30 | magnesium sulfate | 0.50 | 9.50 | 9.50 |
| Example 4 | 14.0 | magnesium sulfate | 0.30 | magnesium sulfate | 0.50 | 8.00 | 8.00 |
| Example 5 | 14.0 | magnesium sulfate | 0.30 | magnesium sulfate | 0.50 | 8.00 | 9.00 |
| Example 6 | 14.0 | magnesium sulfate | 0.30 | magnesium sulfate | 0.50 | 8.50 | 9.00 |
| Example 7 | 14.0 | magnesium sulfate | 0.30 | magnesium sulfate | 0.50 | 9.50 | 9.50 |
| Example 8 | 14.0 | magnesium sulfate | 0.30 | magnesium sulfate | 0.50 | 10.00 | 10.00 |
| Example 9 | 14.0 | aluminum chloride | 0.05 | aluminum chloride | 0.10 | 9.00 | 9.50 |
| Example 10 | 14.0 | iron(III) chloride | 0.05 | iron(III) chloride | 0.10 | 9.00 | 9.50 |
| Example 11 | 14.0 | magnesium sulfate | 0.30 | not added | | 9.00 | 9.50 |
| Example 12 | 14.0 | magnesium sulfate | 0.30 | magnesium sulfate | 9.00 | 9.00 | 9.50 |
| Example 13 | 14.0 | magnesium sulfate | 0.30 | magnesium sulfate | 0.50 | 9.00 | 9.50 |
| Example 14 | 14.0 | cobalt(II) chloride | 0.30 | cobalt(II) chloride | 0.50 | 9.00 | 9.50 |
| Example 15 | 14.0 | magnesium sulfate | 0.50 | magnesium sulfate | 0.40 | 9.00 | 9.50 |
| Example 16 | 14.0 | aluminum chloride | 0.05 | not added | | 9.00 | 9.50 |
| Example 17 | 14.0 | aluminum chloride | 0.05 | aluminum chloride | 0.20 | 9.00 | 9.50 |
| Example 18 | 14.0 | aluminum chloride | 0.05 | aluminum chloride | 0.30 | 9.00 | 9.50 |
| Example 19 | 14.0 | iron(III) chloride | 0.10 | iron(III) chloride | 0.10 | 9.00 | 9.50 |
| Example 20 | 14.0 | iron(III) chloride | 0.10 | iron(III) chloride | 0.40 | 9.00 | 9.50 |
| Example 21 | 14.0 | iron(III) chloride | 0.10 | not added | | 9.00 | 9.50 |
| Example 22 | 14.0 | iron(III) chloride | 0.10 | iron(III) chloride | 0.60 | 9.00 | 9.50 |
| Example 23 | 14.0 | magnesium sulfate | 0.30 | magnesium sulfate | 0.20 | 9.00 | 9.50 |
| Example 24 | 14.0 | magnesium sulfate | 0.30 | magnesium sulfate | 1.00 | 9.00 | 9.50 |
| Example 25 | 14.0 | magnesium sulfate | 0.30 | magnesium sulfate | 0.10 | 9.00 | 9.50 |
| Example 26 | 14.0 | magnesium sulfate | 0.30 | magnesium sulfate | 1.20 | 9.00 | 9.50 |
| Example 27 | 14.0 | calcium chloride | 0.30 | calcium chloride | 0.20 | 9.00 | 9.50 |
| Example 28 | 14.0 | calcium chloride | 0.30 | calcium chloride | 1.00 | 9.00 | 9.50 |
| Example 29 | 14.0 | calcium chloride | 0.30 | calcium chloride | 0.10 | 9.00 | 9.50 |
| Example 30 | 14.0 | calcium chloride | 0.30 | calcium chloride | 1.20 | 9.00 | 9.50 |

TABLE 1-continued

| | Amount of organosilicon compound added (parts) | Flocculant Type | Flocculant Amount (parts) | Additional additive metal compound Type | Additional additive metal compound Amount (parts) | Adjusted pH pH adjustment 2 | Adjusted pH pH adjustment 3 |
|---|---|---|---|---|---|---|---|
| Example 31 | 1.2 | magnesium sulfate | 0.30 | magnesium sulfate | 0.50 | 9.00 | 9.50 |
| Example 32 | 2.0 | magnesium sulfate | 0.30 | magnesium sulfate | 0.50 | 9.00 | 9.50 |
| Example 33 | 24.0 | magnesium sulfate | 0.30 | magnesium sulfate | 0.50 | 9.00 | 9.50 |
| Example 34 | 36.0 | magnesium sulfate | 0.30 | magnesium sulfate | 0.50 | 9.00 | 9.50 |
| Example 35 | 14.0 | magnesium sulfate | 0.30 | magnesium sulfate | 0.50 | 9.00 | 9.50 |
| Comparative example 1 | not added | magnesium sulfate | 0.30 | magnesium sulfate | 0.50 | 9.00 | 9.50 |
| Comparative example 2 | 14.0 | magnesium sulfate | 0.30 | magnesium sulfate | 0.50 | 9.00 | 9.50 |
| Comparative example 3 | 0.8 | magnesium sulfate | 0.30 | magnesium sulfate | 0.50 | 8.50 | 8.50 |
| Comparative example 4 | 36.0 | magnesium sulfate | 0.30 | magnesium sulfate | 0.50 | 10.00 | 10.00 |
| Comparative example 5 | 14.0 | magnesium sulfate | 0.30 | magnesium sulfate | 0.50 | 4.00 | 4.00 |
| Comparative example 6 | 14.0 | potassium hydroxide | 3.00 | potassium hydroxide | 1.00 | 9.00 | 9.50 |
| Comparative example 7 | 14.0 | potassium hydroxide | 3.00 | potassium hydroxide | 5.00 | 9.00 | 9.50 |
| Comparative example 8 | 14.0 | potassium hydroxide | 5.00 | potassium hydroxide | 15.00 | 9.00 | 9.50 |
| Comparative example 9 | 14.0 | copper(II) chloride | 0.30 | copper(II) chloride | 0.50 | 9.00 | 9.50 |
| Comparative example 10 | 14.0 | tin(II) chloride | 0.30 | tin(II) chloride | 0.50 | 9.00 | 9.50 |
| Comparative example 11 | 14.0 | magnesium sulfate | 0.20 | not added | | 9.00 | 9.50 |
| Comparative example 12 | 14.0 | magnesium sulfate | 0.50 | magnesium sulfate | 1.50 | 9.00 | 9.50 |

TABLE 2

| | Silicon density dSi (atom %) | Percentage of area of peak assigned to structure of formula (1) (%) | Polyvalent metal element detected by X-ray fluorescence | Net intensity originating from metal element described in left column | Organosilicon polymer content (% by mass) | Average thickness of surface layer (nm) | Percentage of surface layer with thickness of 2.5 nm or less (%) |
|---|---|---|---|---|---|---|---|
| Example 1 | 23.5 | 70 | magnesium | 10.00 | 4.5 | 30.0 | 6.3 |
| Example 2 | 3.0 | 70 | magnesium | 10.00 | 2.0 | 15.0 | 9.4 |
| Example 3 | 28.0 | 70 | magnesium | 10.00 | 4.5 | 30.0 | 6.3 |
| Example 4 | 23.5 | 23 | magnesium | 10.00 | 4.5 | 30.0 | 6.3 |
| Example 5 | 23.5 | 35 | magnesium | 10.00 | 4.5 | 30.0 | 6.3 |
| Example 6 | 23.5 | 45 | magnesium | 10.00 | 4.5 | 30.0 | 6.3 |
| Example 7 | 23.5 | 75 | magnesium | 10.00 | 4.5 | 30.0 | 6.3 |
| Example 8 | 23.5 | 85 | magnesium | 10.00 | 4.5 | 30.0 | 6.3 |
| Example 9 | 23.5 | 70 | aluminum | 0.30 | 4.5 | 30.0 | 6.3 |
| Example 10 | 23.5 | 70 | iron | 3.00 | 4.5 | 30.0 | 6.3 |
| Example 11 | 23.5 | 70 | magnesium | 0.20 | 4.5 | 30.0 | 6.3 |
| Example 12 | 23.5 | 70 | magnesium | 29.00 | 4.5 | 30.0 | 6.3 |
| Example 13 | 23.5 | 70 | magnesium | 10.00 | 4.5 | 30.0 | 6.3 |
| Example 14 | 23.5 | 70 | cobalt | 10.00 | 4.5 | 30.0 | 6.3 |
| Example 15 | 23.5 | 70 | magnesium<br>iron | 3.50<br>4.00 | 4.5 | 30.0 | 6.3 |
| Example 16 | 23.5 | 70 | aluminum | 0.15 | 4.5 | 30.0 | 6.3 |
| Example 17 | 23.5 | 70 | aluminum | 0.45 | 4.5 | 30.0 | 6.3 |
| Example 18 | 23.5 | 70 | aluminum | 0.55 | 4.5 | 30.0 | 6.3 |
| Example 19 | 23.5 | 70 | iron | 1.05 | 4.5 | 30.0 | 6.3 |
| Example 20 | 23.5 | 70 | iron | 4.50 | 4.5 | 30.0 | 6.3 |
| Example 21 | 23.5 | 70 | iron | 0.50 | 4.5 | 30.0 | 6.3 |
| Example 22 | 23.5 | 70 | iron | 5.50 | 4.5 | 30.0 | 6.3 |
| Example 23 | 23.5 | 70 | magnesium | 3.50 | 4.5 | 30.0 | 6.3 |
| Example 24 | 23.5 | 70 | magnesium | 19.00 | 4.5 | 30.0 | 6.3 |
| Example 25 | 23.5 | 70 | magnesium | 2.50 | 4.5 | 30.0 | 6.3 |
| Example 26 | 23.5 | 70 | magnesium | 21.00 | 4.5 | 30.0 | 6.3 |
| Example 27 | 23.5 | 70 | calcium | 3.50 | 4.5 | 30.0 | 6.3 |
| Example 28 | 23.5 | 70 | calcium | 19.00 | 4.5 | 30.0 | 6.3 |
| Example 29 | 23.5 | 70 | calcium | 2.50 | 4.5 | 30.0 | 6.3 |
| Example 30 | 23.5 | 70 | calcium | 21.00 | 4.5 | 30.0 | 6.3 |
| Example 31 | 10.0 | 70 | magnesium | 10.00 | 0.4 | 4.0 | 18.8 |
| Example 32 | 15.0 | 70 | magnesium | 10.00 | 0.6 | 6.0 | 15.6 |
| Example 33 | 25.0 | 70 | magnesium | 10.00 | 8.0 | 95.0 | 0 |
| Example 34 | 28.0 | 70 | magnesium | 10.00 | 12.0 | 105.0 | 0 |
| Example 35 | 15.0 | 70 | magnesium | 10.00 | 4.5 | 10.0 | 12.5 |
| Comparative example 1 | 0.0 | 0 | magnesium | 10.00 | 0.0 | 0.0 | 100.0 |
| Comparative example 2 | 4.0 | 0 | magnesium | 10.00 | 4.5 | 2.0 | 53.1 |
| Comparative example 3 | 2.0 | 18 | magnesium | 10.00 | 0.3 | 3.0 | 21.9 |
| Comparative example 4 | 30.0 | 80 | magnesium | 10.00 | 12.0 | 130.0 | 22.5 |
| Comparative example 5 | 23.5 | 18 | magnesium | 10.00 | 4.5 | 30.0 | 6.3 |
| Comparative example 6 | 23.5 | 70 | potassium (monovalent) | 10.00 | 4.5 | 30.0 | 6.3 |
| Comparative example 7 | 23.5 | 70 | potassium (monovalent) | 30.00 | 4.5 | 30.0 | 6.3 |

TABLE 2-continued

| | Silicon density dSi (atom %) | Percentage of area of peak assigned to structure of formula (1) (%) | Polyvalent metal element detected by X-ray fluorescence | Net intensity originating from metal element described in left column | Organosilicon polymer content (% by mass) | Average thickness of surface layer (nm) | Percentage of surface layer with thickness of 2.5 nm or less (%) |
|---|---|---|---|---|---|---|---|
| Comparative example 8 | 23.5 | 70 | potassium (monovalent) | 60.00 | 4.5 | 30.0 | 6.3 |
| Comparative example 9 | 23.5 | 70 | copper | 10.00 | 4.5 | 30.0 | 6.3 |
| Comparative example 10 | 23.5 | 70 | tin | 10.00 | 4.5 | 30.0 | 6.3 |
| Comparative example 11 | 23.5 | 70 | magnesium | 0.04 | 4.5 | 30.0 | 6.3 |
| Comparative example 12 | 23.5 | 70 | magnesium | 31.00 | 4.5 | 30.0 | 6.3 |

TABLE 3

| | Fogging in HH | Development endurance in NN | Ghost in LL | Storage stability | Charging in LL (shaking for 600 s) | Charging in HH (shaking for 30 s) | Strength of surface layer (% by number) |
|---|---|---|---|---|---|---|---|
| Example 1 | A (0.5%) | A | A | A | 80 | 60 | 5 |
| Example 2 | C (1.8%) | C | A | C | 80 | 30 | 10 |
| Example 3 | A (0.5%) | A | C | A | 200 | 60 | 5 |
| Example 4 | C (1.8%) | B | C | A | 200 | 30 | 10 |
| Example 5 | B (1.3%) | A | B | A | 150 | 50 | 10 |
| Example 6 | A (0.5%) | A | A | A | 80 | 60 | 5 |
| Example 7 | A (0.5%) | A | A | A | 80 | 60 | 5 |
| Example 8 | B (1.3%) | B | A | A | 80 | 50 | 10 |
| Example 9 | B (1.3%) | A | A | A | 80 | 50 | 15 |
| Example 10 | A (0.5%) | B | B | A | 150 | 60 | 10 |
| Example 11 | A (0.5%) | A | C | A | 200 | 60 | 15 |
| Example 12 | C (1.8%) | A | A | A | 80 | 20 | 2 |
| Example 13 | A (0.5%) | B | A | A | 80 | 60 | 25 |
| Example 14 | B (1.3%) | B | B | A | 150 | 50 | 25 |
| Example 15 | A (0.5%) | A | B | A | 150 | 60 | 5 |
| Example 16 | A (0.5%) | A | B | A | 150 | 60 | 20 |
| Example 17 | B (1.3%) | A | A | A | 80 | 30 | 5 |
| Example 18 | C (1.8%) | A | A | A | 80 | 20 | 5 |
| Example 19 | A (0.5%) | A | B | A | 150 | 60 | 15 |
| Example 20 | A (0.5%) | A | A | A | 80 | 60 | 5 |
| Example 21 | A (0.5%) | A | C | A | 200 | 60 | 20 |
| Example 22 | A (0.5%) | A | A | A | 80 | 60 | 5 |
| Example 23 | A (0.5%) | A | B | A | 150 | 60 | 15 |
| Example 24 | A (0.5%) | A | A | A | 80 | 60 | 5 |
| Example 25 | A (0.5%) | A | C | A | 200 | 60 | 20 |
| Example 26 | B (1.3%) | A | A | A | 80 | 50 | 4 |
| Example 27 | A (0.5%) | A | B | A | 150 | 60 | 15 |
| Example 28 | A (0.5%) | A | A | A | 80 | 60 | 5 |
| Example 29 | A (0.5%) | A | C | A | 200 | 60 | 20 |
| Example 30 | B (1.3%) | A | A | A | 80 | 50 | 4 |
| Example 31 | C (1.8%) | C | A | C | 80 | 30 | 15 |
| Example 32 | B (1.3%) | B | A | B | 80 | 50 | 10 |
| Example 33 | A (0.5%) | A | B | A | 150 | 60 | 5 |
| Example 34 | A (0.5%) | A | C | A | 200 | 60 | 5 |
| Example 35 | B (1.3%) | B | A | B | 80 | 50 | 10 |
| Comparative example 1 | E (5.0%) | E | A | E | 80 | 10 | 40 |
| Comparative example 2 | D (2.3%) | E | A | D | 80 | 15 | 40 |
| Comparative example 3 | D (2.3%) | E | A | D | 80 | 15 | 40 |
| Comparative example 4 | A (0.5%) | A | D | A | 350 | 60 | 5 |
| Comparative example 5 | E (5.0%) | B | D | C | 350 | 10 | 15 |
| Comparative example 6 | A (0.5%) | D | D | A | 300 | 60 | 35 |
| Comparative example 7 | C (1.8%) | D | C | A | 200 | 30 | 35 |
| Comparative example 8 | E (5.0%) | D | B | A | 150 | 10 | 35 |
| Comparative example 9 | E (5.0%) | A | A | A | 80 | 10 | 5 |
| Comparative example 10 | A (0.5%) | A | D | A | 300 | 60 | 5 |
| Comparative example 11 | A (0.5%) | D | D | A | 280 | 60 | 35 |
| Comparative example 12 | E (5.0%) | A | A | A | 80 | 10 | 5 |

As is clear from Tables 2 and 3, the toners 1 to 35 produced in Examples 1 to 35, which state the methods for producing the toner particles according to embodiments of the present disclosure, have higher development endurance, storage stability, and environmental stability than the comparative toners 1 to 12 produced in Comparative examples 1 to 12, and the use of the toners 1 to 35 is less likely to cause ghosting even when continuous printing is performed at a low printing ratio in the low-temperature and low-humidity environment.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application. No. 2016-095726 filed May 12, 2016, which is hereby incorporated by reference herein in its entirety.

What is claimed is:

1. A toner, comprising:

toner particles each including:

a core portion containing a binder resin; and a surface layer containing an organosilicon polymer, wherein the organosilicon polymer has a partial structure represented by formula (1):

$$R—SiO_{3/2} \quad \text{formula (1)}$$

where R represents a hydrocarbon group having 1 or more and 6 or less carbon atoms, when surfaces of the toner particles are subjected to X-ray photoelectron spectroscopy analysis to determine a carbon atom density dC, an oxygen atom density dO, and a silicon atom density dSi, the silicon atom density dSi is 2.5 atomic % or more and 28.6 atomic % or less with respect to 100.0 atomic % of the total of the carbon atom density dC, the oxygen atom density dO, and the silicon atom density dSi, in a chart obtained by subjecting tetrahydrofuran-insoluble matter of the toner particles to $^{29}$Si-NMR measurement, a percentage of an area of a peak assigned to the partial structure represented by formula (1) described above is 20% or more with respect to a total area of a peak of the organosilicon polymer, each of the toner particles contains a polyvalent metal element having a resistivity of $2.5\times10^{-8}$ Ω·m or more and $10.0\times10^{-8}$ Ω·m or less at 20° C., and when the toner particles are subjected to X-ray fluorescence analysis, a net intensity originating from the polyvalent metal element is 0.10 kcps or more and 30.00 kcps or less.

2. The toner according to claim 1, wherein the binder resin contains a carboxy group, the polyvalent metal element is aluminum, and the net intensity originating from aluminum is 0.10 kcps or more and 0.50 kcps or less.

3. The toner according to claim 1, wherein the binder resin contains a carboxy group, the polyvalent metal element is iron, and the net intensity originating from iron is 1.00 kcps or more and 5.00 kcps or less.

4. The toner according to claim 1, wherein the binder resin contains a carboxy group, the polyvalent metal element is magnesium or calcium, and the net intensity originating from magnesium or calcium is 3.00 kcps or more and 20.00 kcps or less.

5. The toner according to claim 1, wherein a content of the organosilicon polymer in each of the toner particles is 0.5% or more by mass and 10.5% or less by mass, and the surface layer containing the organosilicon polymer has an average thickness Dav. of 5.0 nm or more and 100.0 nm or less, the average thickness Dav. being measured by observation of cross sections of the toner particles using a transmission electron microscope.

6. The toner according to claim 1, wherein R represents a methyl group.

* * * * *